US009093823B2

(12) United States Patent
Sakakura et al.

(10) Patent No.: US 9,093,823 B2
(45) Date of Patent: Jul. 28, 2015

(54) SPARK PLUG AND METHOD OF MANUFACTURING SPARK PLUG

(75) Inventors: Yasushi Sakakura, Aichi (JP); Yuichi Matsunaga, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 465 days.

(21) Appl. No.: 13/521,255

(22) PCT Filed: Dec. 27, 2010

(86) PCT No.: PCT/JP2010/007535

§ 371 (c)(1), (2), (4) Date: Jul. 10, 2012

(87) PCT Pub. No.: WO2011/086651

PCT Pub. Date: Jul. 21, 2011

(65) Prior Publication Data

US 2012/0299459 A1 Nov. 29, 2012

(30) Foreign Application Priority Data

| | | |
|---|---|---|
| Jan. 15, 2010 | (JP) | 2010-006477 |
| Mar. 2, 2010 | (JP) | 2010-045313 |
| Mar. 2, 2010 | (JP) | 2010-045314 |
| May 18, 2010 | (JP) | 2010-114129 |
| Nov. 25, 2010 | (JP) | 2010-262969 |

(51) Int. Cl.
*H01T 13/20* (2006.01)
*H01T 13/32* (2006.01)
(Continued)

(52) U.S. Cl.
CPC ..... *H01T 13/32* (2013.01); *H01T 13/467* (2013.01); *H01T 13/54* (2013.01); *H01T 21/02* (2013.01)

(58) Field of Classification Search
CPC ..... H01T 13/32
USPC ..... 313/141
See application file for complete search history.

(56) References Cited

U.S. PATENT DOCUMENTS

| | | | | |
|---|---|---|---|---|
| 2,652,044 | A | 9/1953 | Phillips | 123/169 |
| 6,013,973 | A | 1/2000 | Sato | 313/143 |

(Continued)

FOREIGN PATENT DOCUMENTS

| | | | |
|---|---|---|---|
| DE | 10144976 A1 | 4/2003 | H01T 13/54 |
| EP | 1936144 | 6/2008 | F02B 19/12 |

(Continued)

OTHER PUBLICATIONS

English translation of NIESSNER (DE 101 44 976 A1) (Apr. 2003).*

(Continued)

*Primary Examiner* — Anh Mai
*Assistant Examiner* — Hana Featherly
(74) *Attorney, Agent, or Firm* — Kusner & Jaffe

(57) ABSTRACT

An ignition plug having a metallic shell with a through hole extending therethrough in an axial direction, an insulator fitted into the through hole of the metallic shell and having an axial hole extending in the axial direction, and a center electrode fitted into the axial hole of the insulator. The ignition plug further includes a cap member which covers a front end opening of the metallic shell, provided on a front end side thereof where the center electrode is disposed, to thereby form an ignition chamber at the front end portion of the metallic shell, and a ground electrode disposed within the ignition chamber and facing a circumferential surface of the center electrode directly or indirectly.

10 Claims, 34 Drawing Sheets

(51) Int. Cl.

| | |
|---|---|
| ***H01T 13/46*** | (2006.01) |
| ***H01T 13/54*** | (2006.01) |
| ***H01T 21/02*** | (2006.01) |

(56) References Cited

U.S. PATENT DOCUMENTS

| | | | | |
|---|---|---|---|---|
| 7,856,956 | B2 | 12/2010 | Inoue et al. | 123/267 |
| 2004/0100179 | A1 | 5/2004 | Boley et al. | 313/143 |
| 2005/0174025 | A1 | 8/2005 | Okamoto | 313/143 |
| 2006/0082276 | A1 | 4/2006 | Havard et al. | 313/141 |
| 2007/0069617 | A1 | 3/2007 | Tozzi et al. | 313/140 |
| 2007/0119409 | A1 | 5/2007 | Johng et al. | 123/267 |
| 2009/0133667 | A1 | 5/2009 | Inoue et al. | 123/260 |

FOREIGN PATENT DOCUMENTS

| | | | | |
|---|---|---|---|---|
| GB | 475838 | A | 11/1937 | H01T 13/46 |
| GB | 517586 | | 2/1940 | |
| JP | 53-130325 | | 10/1978 | |
| JP | H0237485 | U | 3/1990 | H01T 13/32 |
| JP | H0461778 | A | 2/1992 | H01T 13/16 |
| JP | 2003519431 | | 6/2003 | |
| JP | 2005-251727 | A | 9/2005 | H01T 13/20 |
| JP | 2008-504649 | | 2/2008 | H01T 13/54 |
| JP | 2008-517427 | | 5/2008 | H01T 13/46 |
| JP | 2009-302066 | A | 12/2009 | B23K 11/14 |
| WO | WO 2004/107518 | A1 | 12/2004 | H01T 13/54 |
| WO | WO 2006/011950 | | 2/2006 | F02B 19/00 |

OTHER PUBLICATIONS

Form PCT/ISA/210—Int'l Search Report (from corresponding Int'l Patent App. No. PCT/JP2010/007535—English version only); 2 pages.

Office Action in corresponding Japanese Patent Application 2011-003478, dated Dec. 3, 2013, with English translation; 5 pages.

Office Action issued in corresponding Japanese Patent Application No. 2010-262969, Mar. 4, 2014 (English-language translation provided).

International Search Report for corresponding European Patent ApplicationNo. 10843010, dated Jan. 28, 2014—3 pages.

* cited by examiner

1: METALLIC SHELL
2: INSULATOR
3: CENTER ELECTRODE
4: IGNITION CHAMBER
5: AXIAL HOLE
6: GROUND ELECTRODE
7: THROUGH HOLE
8: SCREW SHAFT PORTION
11: CAP MEMBER
12: HOLE
G: GAP

SPARK PLUG AND METHOD OF MANUFACTURING SPARK PLUG

FIELD OF THE INVENTION

The present invention relates to an ignition plug and a method of manufacturing the ignition plug.

BACKGROUND OF THE INVENTION

Int'l Publication No. WO 2006/011950 discloses a conventional ignition plug. As shown in FIGS. 14 and 15 of the present application, a conventional ignition plug includes an electrically conductive metallic shell 101 having a through hole 100 extending therethrough in the axial direction. An insulator 102 is attached to the through hole 100 of the metallic shell 101, and a center electrode 103 attached to the insulator 102. Defining the side where the center electrode 103 is disposed as a "front end side," the metallic shell 101 has an opening (front end opening) 104 on the front end side. The ignition plug includes a cap member 107 having a hole 106. Cap member 107 is provided at the front end of the metallic shell 101 and covers the front end opening 104 of the metallic shell 101, to thereby form an ignition chamber 105. Four semi-circular ground electrodes 108 project from the wall surface of the ignition chamber 105 toward the circumferential surface of the center electrode 103.

Such an ignition plug, having the ignition chamber 105 at the front end of the metallic shell 101 (hereinafter also referred to as a "prechamber plug"), introduces an air-fuel mixture within a combustion chamber of an internal combustion engine into the ignition chamber 105 via the hole 106 of the cap member 107, produces spark discharge at a gap G between the center electrode 103 and the ground electrode 108 so as to ignite the mixture, to thereby generate a flame in the ignition chamber 105. The flame is jetted from the hole 106 of the cap member 107 into the combustion chamber of the internal combustion engine, and is spread across the entire combustion chamber. As described above, such a prechamber plug is excellent in ignition performance, and allows for construction of an internal combustion engine which is high in combustion speed. Therefore, such a prechamber plug is used mainly for internal combustion engines, such as engines for cogeneration and gas engines for compressors.

Since the ignition plug ignites an air-fuel mixture by producing spark discharge at the gap G between the center electrode 103 and the ground electrode 108, whether or not the size of the gap G falls within a prescribed range is an important factor which determines its ignition performance.

However, in the prechamber plug, since the center electrode 103 and the ground electrodes 108 are located within the ignition chamber 105, correction of the gap G (gap adjustment) is structurally difficult to perform. Therefore, the conventional prechamber plug is designed such that the size of the gap G is brought into a prescribed range through accurate assembly of the metallic shell 101, the insulator 102, and the center electrode 103 during a manufacturing process.

However, by means of manufacturing 25 conventional prechamber plugs (the number of ground electrodes=4) on a trial basis and measuring 100 gaps G in total, the present inventor found that, despite the target range for the gap G being set to 0.27 mm to 0.33 mm, in actuality, the size of the gap G greatly varied within a range of 0.14 mm to 0.46 mm, as indicated by solid lines in the graph of FIG. 9.

The present invention has been accomplished in view of the above-described problem, and its object is to provide a prechamber plug whose spark discharge gap is readily corrected (gap adjustment is readily performed), and a method of manufacturing the prechamber plug.

SUMMARY OF THE INVENTION

Aspect 1

In accordance with the present invention, there is provided an ignition plug comprised of a metallic shell having a through hole extending therethrough in an axial direction. An insulator is fitted into the through hole of the metallic shell and has an axial hole extending in the axial direction. A center electrode is fitted into the axial hole of the insulator. A cap member covers a front end opening of the metallic shell. The cap member is provided on a front end side of the metallic shell where the center electrode is disposed, to thereby form an ignition chamber in a front end portion of the metallic shell. A ground is electrode disposed within the ignition chamber and faces a circumferential surface of the center electrode directly or indirectly, wherein the ground electrode has a rod-like shape. A proximal end portion of the ground electrode is fixed to the metallic shell such that the ground electrode is cantilevered and extends in a chord direction of the ignition chamber, and a distal end portion of the ground electrode faces the circumferential surface of the center electrode directly or indirectly via a gap.

Notably, in the present invention, the expression "the ground electrode faces the circumferential surface of the center electrode indirectly via a gap" means that the ground electrode faces the circumferential surface of the insulator and faces the circumferential surface of the center electrode indirectly via the gap. In such a case, spark discharge propagates to the center electrode along the surface of the insulator (creeping discharge).

Aspect 2

In accordance with another aspect of the present invention, there is provided an ignition plug as described above, wherein the second moment of area I of the ground electrode when a load is applied to the distal end in a radial direction of the ignition chamber is 2 $mm^4$ or less.

In this case, preferably, the ground electrode is formed of a material having a hardness of 120 MHV to 500 MHV.

Preferably, the ground electrode is a quadrangular bar formed of a noble metal.

Alternatively, the ground electrode may be a quadrangular bar which is formed of an Ni alloy and have a noble metal tip provided at a position facing the circumferential surface of the center electrode.

Aspect 3

In accordance with another aspect of the present invention, there is provided an ignition plug as described above, wherein the ground electrode is joined to the metallic shell at a position determined such that a shortest distance between a front end surface of the metallic shell and the ground electrode as measured in the axial direction becomes 3 mm or greater.

Aspect 4

In accordance with another aspect of the present invention, there is provided an ignition plug as described above, wherein the metallic shell has a screw shaft portion at the front end thereof; and the ground electrode is joined to the metallic shell at a position shifted 3 mm or more from a start point of the screw shaft portion at the front end thereof with respect to the axial direction. Notably, the "start point of the screw shaft portion at the front end thereof with respect to the axial direction" means a point on the screw shaft portion from which formation of a thread is started.

Aspect 5

In accordance with another aspect of the present invention, there is provided an ignition plug as described above, wherein the ratio of a volume Ve of a portion of the electrode, the portion projecting into the ignition chamber, to a volume Vc of the ignition chamber is 10% or less.

Aspect 6

In accordance with another aspect of the present invention, there is provided an ignition plug as described above, wherein the ratio of a total electrode area Sec, which is the sum of a cross-sectional area Se of the ground electrode as measured on a cross section of the ignition chamber crossing the ground electrode in a radial direction and a cross-sectional area Sc of the center electrode as measured on the cross section, to a cross-sectional area Sp of the cross section of the ignition chamber is 50% or less; and the ratio of a volume Vh of a portion of the ignition chamber extending frontward from a rear end surface of the ground electrode to a volume Vc of the ignition chamber is 50% or greater.

Aspect 7

In accordance with another aspect of the present invention, there is provided an ignition plug as described above, further comprising a metal fitting disposed adjacent to the proximal end portion of the ground electrode, wherein the proximal end portion is fixedly held between the metal fitting and the metallic shell.

Aspect 8

In accordance with another aspect of the present invention, there is provided an ignition plug as described above, wherein the metal fitting has a cylindrical tubular shape; the metallic shell has, at its front end, a diameter-increased hole into which the metal fitting is fitted; and the metal fitting is joined to the metallic shell in a state in which the ground electrode is sandwiched between a step portion at the rear end of the diameter-increased hole and a rear end portion of the metal fitting.

Aspect 9

In accordance with another aspect of the present invention, there is provided an ignition plug as described above, wherein a clearance is formed between an outer circumferential surface of the metal fitting and a wall surface of the diameter-increased hole; and the step portion at the rear end of the diameter-increased hole and the rear end portion of the metal fitting are joined together through resistance welding.

Aspect 10

In accordance with another aspect of the present invention, there is provided an ignition plug as described above, wherein a recess is formed on at least one of the outer circumferential surface of the metal fitting and the wall surface of the diameter-increased hole; and the recess forms the clearance.

Aspect 11

In accordance with another aspect of the present invention, there is provided a method of manufacturing an ignition plug as described above, comprising an assembly step of assembling components, excluding the cap member, to the metallic shell; a gap adjustment step of, after the assembly step, adjusting the gap between the circumferential surface of the center electrode and the ground electrode facing the circumferential surface of the center electrode directly or indirectly; and an ignition chamber forming step of, after the gap adjustment step, attaching the cap member to the front end opening of the metallic shell to thereby form the ignition chamber at the front end portion of the metallic shell.

Aspect 12

In accordance with another aspect of the present invention, there is provided an ignition plug manufacturing method as described above, wherein the gap adjustment step uses an adjustment jig which is rotatable about a center axis of the metallic shell extending in the axial direction and is dimensioned such that at least a front end of the adjustment jig can be inserted into the through hole of the metallic shell; and the gap adjustment step includes inserting the adjustment jig into the through hole of the metallic shell along the axial direction of the ignition plug, and rotating the adjustment jig about the center axis so as to press the ground electrode to thereby adjust the gap.

Aspect 13

In accordance with another aspect of the present invention, there is provided a method of manufacturing an ignition plug as described above, comprising a first step of fixing the ground electrode to the metal fitting; and a second step of fixedly attaching the metal fitting, to which the ground electrode has been fixed by the first step, such that the ground electrode is disposed between the metal fitting and the metallic shell.

Aspect 14

In accordance with another aspect of the present invention, there is provided a method of manufacturing an ignition plug as described above, comprising a fifth step of fixing the ground electrode to the metallic shell; and a sixth step of fixedly attaching the metal fitting to the metallic shell, to which the ground electrode has been fixed by the fifth step, such that the metal fitting is located adjacent to the proximal end portion of the ground electrode.

Aspect 15

In accordance with another aspect of the present invention, there is provided an ignition plug manufacturing method as described above, wherein the metal fitting has a cylindrical tubular shape, and the metallic shell has, at its front end, a diameter-increased hole into which the metal fitting is fitted; the method comprises a step of bringing the butting of a welding jig into contact with the front end of the metal fitting and joining the metallic shell and the metal fitting together through resistance welding; the welding jig used in this step has a convex portion which can be removably inserted into an end portion of the metal fitting and is positioned by the metal fitting; and a radius difference $\lambda_1$ between an inner diameter of the metal fitting and an outer diameter of the convex portion and a radius difference $\lambda_2$ between an inner diameter of the metallic shell and a diameter of a portion of the welding jig facing an inner circumferential surface of the metallic shell satisfy a relation $\lambda_2>\lambda_1$.

In the ignition plug of the present invention, one end of a rod-shaped ground electrode is fixed to the metallic shell such that the ground electrode is cantilevered and extends in a chord direction of the ignition chamber. Therefore, a load in a radial direction of the ignition chamber can be applied to the ground electrode at any position between the fixed end of the ground electrode and the other end. Therefore, even in the case of a prechamber plug in which the center electrode and the ground electrode are provided within the ignition chamber, the gap can be readily adjusted. For example, the gap is greatly adjusted by applying a load to a portion of the ground electrode near the fixed end, or the gap is finely adjusted by applying a load to the free end side of the ground electrode.

In general, the resistance of an object to deformation caused by bending moment can be represented by a second moment of area I corresponding to the cross-sectional shape thereof. For example, in the case of an object having a rectangular cross section, $I=WT^3/12$ where T represents the length of a side parallel to a direction in which a bending load acts, and W represents the length of another side orthogonal to that direction. In the case of an object having a square cross section, $I=A^4/12$ where A represents the length of a side of the square cross section. In the ignition plug of the present invention, by setting the second moment of area I of the ground electrode to 2 $mm^4$ or less as described above, the time required for adjusting the gap can be shortened to a level which enables mass production.

Also, the resistance of an object to deformation caused by bending moment can be represented by the hardness of the material of the object. In the ignition plug of the present invention, by setting the hardness of the material of the ground electrode to 120 MHV to 500 MHV, it is possible to make the time required for adjusting the gap fall within a range in which mass production is possible, without impairing the required strength.

Since an engine for cogeneration is continuously operated under full load in many cases, a prechamber plug frequently used for such an engine for cogeneration is required to have excellent durability. Therefore, preferably, the ground electrode is a quadrangular bar formed of noble metal. Thus, it becomes possible to improve durability, which is important for the prechamber plug.

Meanwhile, since noble metal is expensive, preferably, the ground electrode is a quadrangular bar which is formed of an Ni alloy and have a noble metal tip provided at a position facing the circumferential surface of the center electrode. Thus, it becomes possible to improve durability while suppressing an increase in cost.

Although the ignition plug of the present invention is a prechamber plug in which the center electrode and the ground electrode are provided within the ignition chamber as described above, the ignition plug is advantageous in that the gap can be readily adjusted. For example, the gap is greatly adjusted by applying a load to a portion of the ground electrode near the fixed end, or the gap is finely adjusted by applying a load to the free end side of the ground electrode. Such advantage becomes remarkable when, as described above, the ground electrode is joined to the metallic shell at a deep position determined such that the shortest distance between the front end surface of the metallic shell and the ground electrode as measured in the axial direction becomes 3 mm or greater.

Heat of the ignition plug escapes from the screw shaft portion of the metallic shell to the main body of an internal combustion engine. Therefore, even in the case where the distance between the joining/fixing position of the ground electrode and the front end surface of the metallic shell is 3 mm or greater as described above, if the position is located frontward of the start point of the screw shaft portion, heat transmission is poor, and the ground electrode is exposed to high temperature. In such a case, separation may occur at the joint portion. However, the ground electrode becomes unlikely to be exposed to high temperature, when the joining/fixing position of the ground electrode is shifted from the start point of the screw shaft portion of the metallic shell by 3 mm or greater as described above.

The feature of the prechamber plug resides in excellent ignition performance as described above. This ignition performance can be enhanced by the configuration described above. That is, when the ratio of the volume Ve (see FIG. 10(*b*)) of a portion of the electrode, the portion projecting into the ignition chamber, to the volume Vc (see FIG. 10(*a*)) of the ignition chamber is set to 10% or less, an unburned air-fuel mixture can be sufficiently introduced into the ignition chamber, whereby a satisfactory flame jet can be generated. Accordingly, such a configuration is effective for enhancing the ignition performance.

Furthermore, in the case where, as described above, the ratio of the total electrode area Sec, which is the sum of the cross-sectional area Se (see FIG. 11(*b*)) of the ground electrode as measured on a cross section of the ignition chamber crossing the ground electrode in a radial direction and the cross-sectional area Sc (see FIG. 11(*b*)) of the center electrode as measured on the cross section, to the cross-sectional area Sp (see FIG. 11(*a*)) of the cross section of the ignition chamber is 50% or less, and the ratio of the volume Vh (see FIG. 10(*c*)) of a portion of the ignition chamber extending frontward from the rear end surface of the ground electrode to the volume Vc (see FIG. 10(*a*)) of the ignition chamber is 50% or greater, when an unburned air-fuel mixture is taken into the ignition chamber, the unburned air-fuel mixture can be sufficiently taken into the space of the volume Vh extending to the ground electrodes, and the burned air-fuel mixture remaining in the ignition chamber can be pushed into a space at a deeper position via openings between the ground electrodes, the openings having a total area equal to (the area Sp−the area Sec). Therefore, a satisfactory flame jet can be generated. Accordingly, such a configuration is effective for enhancing the ignition performance.

In the ignition plug described above, since the ground electrode is fixed to the metallic shell via the metal fitting, the joint strength and durability of the ground electrode are improved. Therefore, even when a heat load acts on the ground electrode for a long period of time, the joint strength of the ground electrode is unlikely to lower. Also, the durability against heat load can be further enhanced by means of joining the proximal end portion of the ground electrode to at least one of the metal fitting and the metallic shell. Notably, herein, the term "joint" encompasses not only means for fitting the proximal end portion of the ground electrode into a clearance (e.g., a groove) but also all means for unifying the two members so as to enable the members to be handled as a single member, such as welding and brazing.

Also, in the above-described case where a metal fitting having a cylindrical tubular shape is fitted into the diameter-increased hole formed at the front end of the metallic shell and is joined to the metallic shell in a state in which the ground electrode is sandwiched between a step portion at the rear end of the diameter-increased hole and the rear end portion of the metal fitting, the ground electrode can be joined with a high joint strength even at a deep position within the ignition chamber.

In the above-described case where a clearance is formed between the outer circumferential surface of the metal fitting and the wall surface of the diameter-increased hole, and the step portion at the rear end of the diameter-increased hole and the rear end portion of the metal fitting are joined together through resistance welding, welding current concentrates at a limited contact area between the metal fitting and the wall surface of the diameter-increased hole. Therefore, the welding strength of the metal fitting increases. Also, in the above-described case where the clearance is formed by a recess provided on at least one of the outer circumferential surface of the metal fitting and the wall surface of the diameter-increased hole, the metal fitting engages with the wall surface of the diameter-increased hole in regions other than the region where the recess is formed. Therefore, positioning of the metal fitting within the diameter-increased hole becomes easy.

The manufacturing method described above enables mass production of reliable prechamber plugs whose gap sizes fall within a prescribed range.

According to a manufacturing method described above, the adjustment jig is inserted into the through hole of the metallic shell, and the adjustment jig is rotated about the center axis of the metallic shell extending in the axial direction so as to press the ground electrode. Therefore, it becomes possible to accurately adjust the gap between the ground electrode and the center electrode, while preventing the ground electrode from inclining as indicated by a symbol 8 in FIG. 55.

Also, the adjustment jig is inserted into the through hole of the metallic shell and is rotated about the center axis; i.e., about the center electrode, to press the ground electrode. Therefore, workability is not affected by the location of the ground electrode; i.e., whether the ground electrode is located near the opening of the metallic shell or located at a deeper position.

Moreover, even in the case where a plurality of ground electrodes are provided, their gaps can be adjusted simultaneously through a single operation. Therefore, workability is not affected by the number of the ground electrodes.

According to an ignition plug manufacturing method described above, the adjustment of the gap for spark discharge can be performed accurately and efficiently and being hardly affected by the position and number of the ground electrodes. Therefore, the productivity of the ignition plug can be improved.

According to another aspect of the manufacturing methods described above, resistance welding is performed in a state in which the convex portion of the welding jig is fitted into the end portion of the metal fitting. Therefore, positional shift of the welding jig can be restrained by the metal fitting. Accordingly, it is possible to prevent welding current from mostly flowing into the metallic shell, which flow would otherwise occur when the welding jig comes into contact with the metallic shell. Thus, the welding current can be concentrated at a welding region, whereby a consistent welding strength can be attained.

Since the radius difference $\lambda_1$ between the inner diameter of the metal fitting and the outer diameter of the convex portion of the welding jig and the radius difference $\lambda_2$ between the inner diameter of the metallic shell and the diameter of a portion of the welding jig facing the inner circumferential surface of the metallic shell are determined to satisfy the relation $\lambda_2>\lambda_1$, it becomes possible to more reliably prevent the welding jig from contacting the metallic shell.

DETAILED DESCRIPTION OF PREFERRED EMBODIMENTS

First Embodiment

A first embodiment of the present invention will now be described with reference to drawings.

Figure 1:
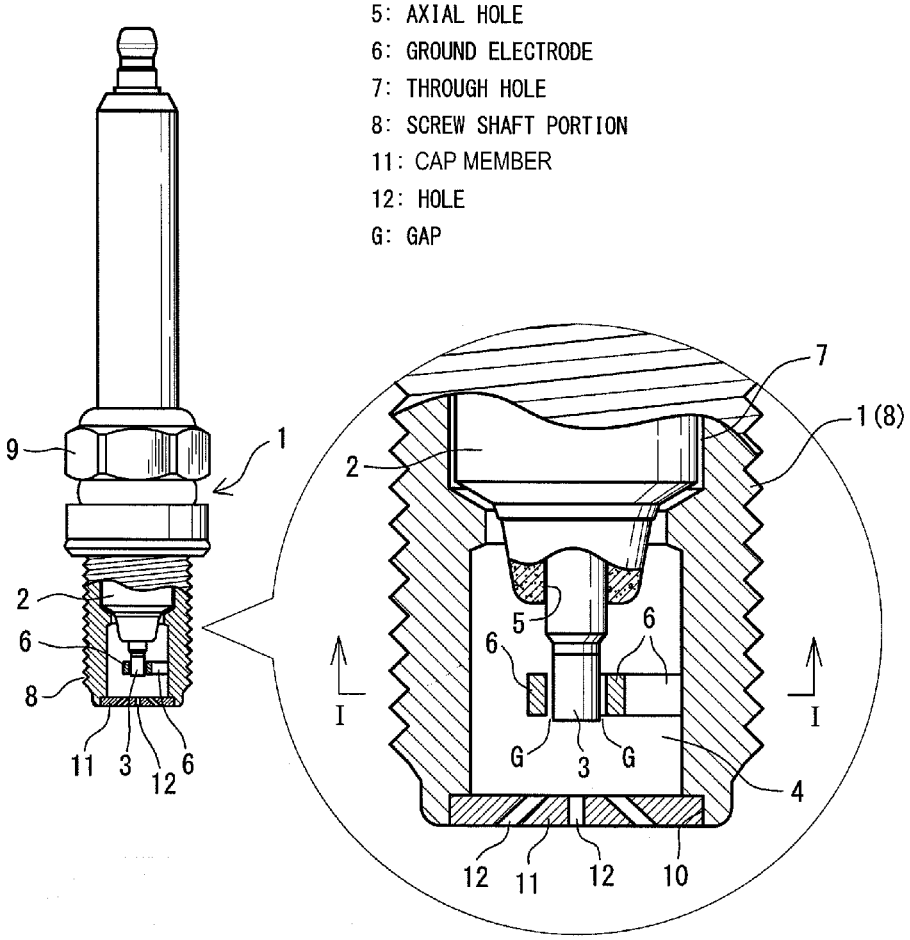
FIG. 1 is a front view of an ignition plug including a partial enlarged view.

As shown in FIG. 1, an ignition plug of the first embodiment includes a metallic shell 1; an insulator 2 attached to the metallic shell 1; a center electrode 3 attached to the insulator 2; an ignition chamber 4 formed at a front end portion of the metallic shell 1 (on the side where the center electrode 3 is disposed); and ground electrodes 6 disposed in the ignition chamber 4 and facing the circumferential surface of the center electrode 3 directly or indirectly.

The metallic shell 1 is a tubular member which has a through hole 7 extending therethrough in the axial direction thereof, and is formed of, for example, low carbon steel. The metallic shell 1 has, at its front end with respect to the axial direction, a screw shaft portion 8, which is screwed into a plug attachment hole (not shown) of a cylinder head or the like. Also, the metallic shell 1 has, at its rear end, a tool engagement portion 9, with which a plug wrench is engaged. A front end portion of the metallic shell 1 surrounds the circumference of a front end portion of the center electrode 3, and a front end opening 10 of the metallic shell 1 is covered by a disk-like cap member 11, whereby the ignition chamber 4 is formed. Notably, the ignition chamber 4 communicates with a combustion chamber (not shown) via a plurality of holes 12 formed in the cap member 11.

The insulator 2 is a tubular member which has an axial hole 5 extending in the axial direction and which is formed of, for example, alumina. A front portion of the insulator 2, whose length is slightly smaller than half the entire length, is inserted into the through hole 7 from the rear end side of the metallic shell 1, whereby the insulator 2 is attached to the metallic shell 1. As shown in the enlarged view of FIG. 1, the front end of the insulator 2 projects into the ignition chamber 4.

The center electrode 3 is a solid round bar attached to the axial hole 5 of the insulator 2. A portion of the center electrode 3 projecting from the front end of the insulator 2 is located at the approximate center of the ignition chamber 4 of the metallic shell 1.

Figure 4:
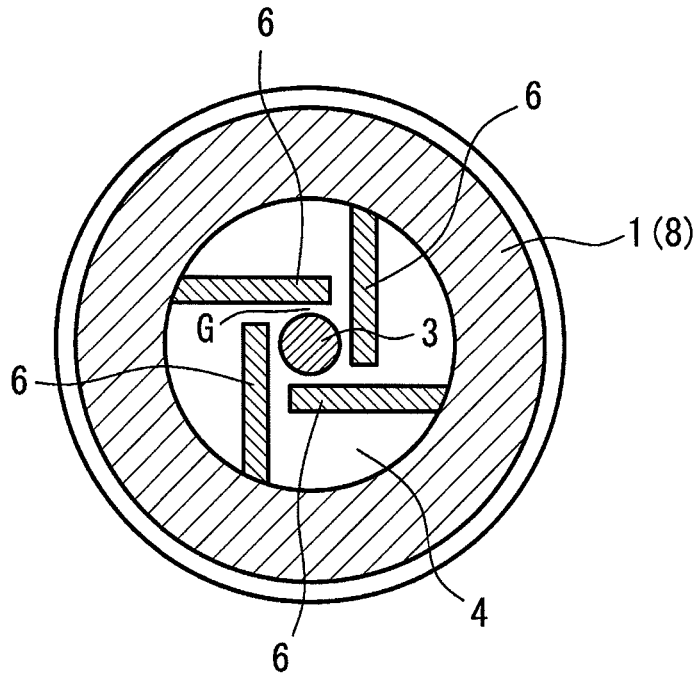
FIG. 4 is a sectional view taken along line I-I of FIG. 1.

Each ground electrode 6 is a quadrangular bar having a rectangular cross section. As shown in FIG. 4, one end of each ground electrode 6 is fixed (for example, welded) to the wall surface of the ignition chamber 4 such that the cantilevered ground electrode 6 extends over 5 to 12 mm in a chord direction of the circular ignition chamber 4, and the free end of the ground electrode 6 faces the circumferential surface of the center electrode 3 directly or indirectly, with a gap G (see FIG. 2) formed therebetween. The illustrated ground electrodes 6 face the circumferential surface of the center electrode 3 directly. However, the ground electrodes 6 may be disposed to face the circumferential surface of the insulator 2 directly such that the ground electrodes 6 face the circumferential surface of the center electrode 3 indirectly. In such a case, spark discharge propagates along the surface of the insulator 2 to the center electrode 3 (creeping discharge).

Notably, as shown in FIG. 4, in the first embodiment, the four ground electrodes 6 are provided at equal intervals, and have a length such that the distal end of each ground electrode 6 does not contact with another ground electrode 6.

Figure 2:
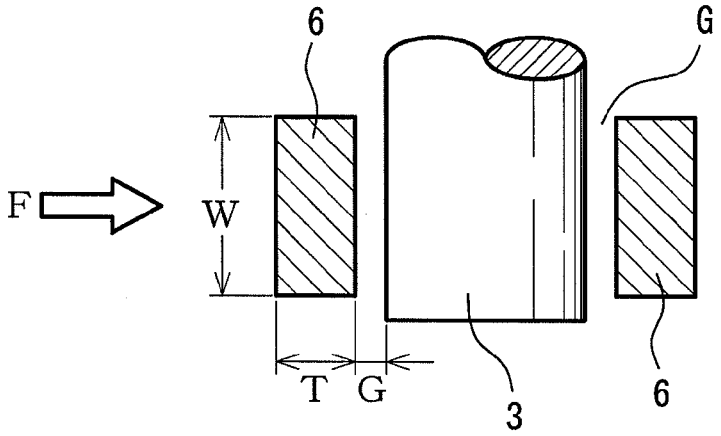
FIG. 2 is a partial enlarged sectional view showing essential portions of a center electrode and ground electrodes.

Moreover, preferably, the cross-sectional shape of each ground electrode 6 is determined such that the second moment of area I for the case where a load F is applied to the free end in the radial direction of the ignition chamber 4 as shown in FIG. 2 becomes 2 $mm^4$ or less. Since the second moment of area of a quadrangular bar having a rectangular cross section is obtained in accordance with a formula $I=WT^3/12$, preferably, the ground electrodes 6 of the first embodiment have a rectangular cross sectional shape determined such that the width W of the ground electrodes 6 becomes 3 mm, and the thickness T of the ground electrodes 6 becomes 2 mm.

Figure 3:
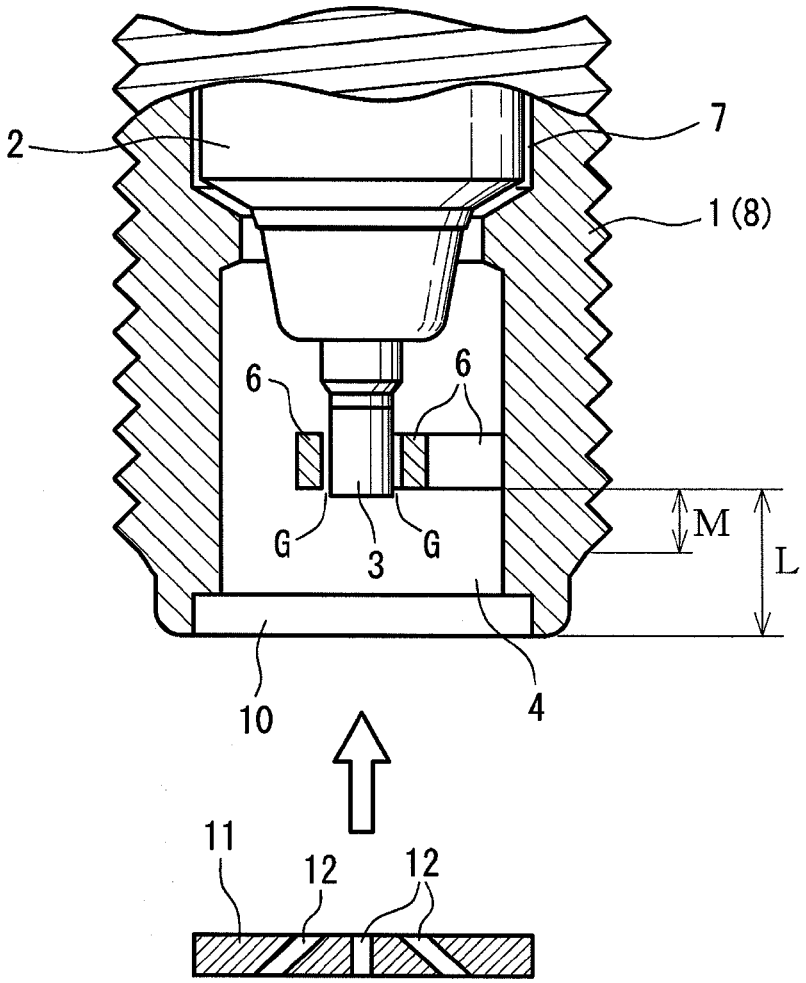
FIG. 3 is an enlarged sectional view of a main portion of the ignition plug showing a state in which a cap member is separated.

Notably, ignition plugs were manufactured on a trial basis in order to clarify the relation between the second moment of area I of the ground electrodes 6 and the work time required for adjusting the gaps G. Specifically, the ground electrodes 6 were formed of the same maternal such that their second moment of area I became 0.17 $mm^4$ (plug A), 0.67 $mm^4$ (plug B), 2.0 $mm^4$ (plug C), or 4.5 $mm^4$ (plug D). The ground electrodes 6 were attached to an ignition plug, and the gaps G were adjusted by a method to be described later. 30 ignition plugs were manufactured for each of the plug types (plugs A to D) and the time required for gap adjustment was measured. Table 1 shows the results of the measurement. Notably, in Tables 1 to 3, (L) in the column showing the specifications of the ground electrodes shows the shortest distance, as measured in the axial direction, between the front end surface of the metallic shell 1 and the ground electrode 6 as shown in FIG. 3.

TABLE 1

Differences in work time required for gap adjustment (4 poles, 30 pieces, gap prescribed value: 0.3 ± 0.003 mm)

| | Specifications of ground electrode | Material of ground electrode | working time |
|---|---|---|---|
| Plug A | T = 1 mm, W = 2 mm (I = 0.17 $mm^4$), L = 3 mm | INC (hardness: 150 MHV) | 10 min |
| Plug B | T = 2 mm, W = 1 mm (I = 0.67 $mm^4$), L = 3 mm | INC (hardness: 150 MHV) | 15 min |
| Plug C | T = 2 mm, W = 3 mm (I = 2.0 $mm^4$), L = 3 mm | INC (hardness: 150 MHV) | 30 min |
| Plug D | T = 3 mm, W = 2 mm (I = 4.5 $mm^4$), L = 3 mm | INC (hardness: 150 MHV) | 60 min |

From these results, it was confirmed that, through setting the second moment of area I of the ground electrodes 6 to 2 $mm^4$ or less, the work time required for adjusting the gaps G can be shortened to a level which allows mass production.

The hardness of the material which forms a rod-like portion of each ground electrode 6 is set to 120 MHV to 500 MHV in order to realize easiness of bending which allows adjustment work suitable for mass production, without impairing the strength required for stabilizing the gaps G.

Ignition plugs were manufactured on a trial basis in order to clarify the relation between the material hardness of the ground electrodes 6 and the work time required for adjusting the gaps G. Specifically, the ground electrodes 6 having the same shape were formed of a material having a hardness of 300 MHV (plug E) or a material having a hardness of 600 MHV (plug F). The ground electrodes 6 were attached to an ignition plug, and the gaps G were adjusted by a method to be described later. 30 ignition plugs were manufactured for each of the plug types (plugs E to F) and the time required for gap adjustment was measured. Table 2 shows the results of the measurement.

TABLE 2

Differences in work time required for gap adjustment (4 poles, 30 pieces, gap prescribed value: 0.3 ± 0.003 mm)

| | Specifications of ground electrode | Material of ground electrode | working time |
|---|---|---|---|
| Plug E | T = 1 mm, W = 2 mm (I = 0.17 $mm^4$), L = 3 mm | Pt—20Ir (hardness: 300 MHV) | 30 min |
| Plug F | T = 1 mm, W = 2 mm (I = 0.17 $mm^4$), L = 3 mm | Ir—20Rh (hardness: 600 MHV) | 60 min |

From these results, it was confirmed that, through setting the material hardness of the ground electrodes 6 to a value equal or less than 500 MHV, which is smaller than 600 MHV, the work time required for adjusting the gaps G can be shortened to a level which allows mass production.

Figure 5:
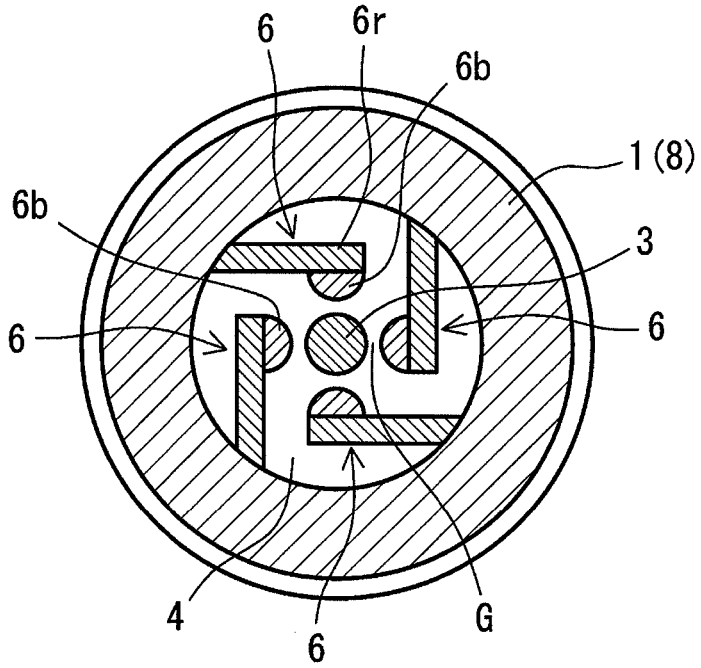
FIG. 5 is a sectional view showing another form of the ground electrodes.
Figure 6:
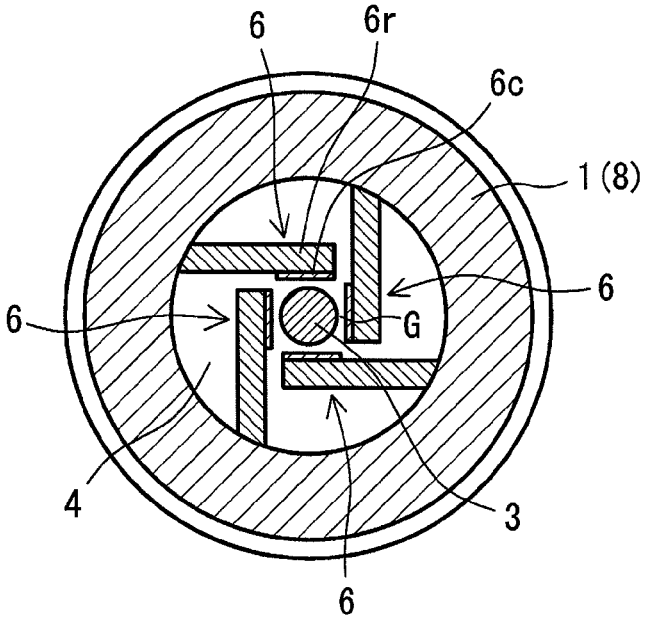
FIG. 6 is a sectional view showing another form of the ground electrodes.

As shown in FIG. 4, the ground electrodes 6 may be in the form of a simple quadrangular bar, and its entirety may be formed of a noble metal (for example, Pt-20Ir: 300 MHV). Alternatively, as shown in FIGS. 5 and 6, each of the ground electrodes 6 may be composed of a quadrangular bar 6*r* formed of a relatively inexpensive alloy (for example, Ni alloy: 150 MHV), and a noble metal tip (for example, a tip formed of Pt-20Ir) 6*b*, 6*c* which assumes the form of a semi-circular column or a thin plate and which is joined to the free end of the quadrangular bar 6*r* at a position facing the circumferential surface of the center electrode 3. Selection can be made between the ground electrodes 6 of FIG. 4, which are excellent in durability, and the ground electrodes 6 of FIGS. 5 and 6, which are superior from the viewpoint of cost.

Next, a method of manufacturing the above-described ignition plug will be described. A process of manufacturing the ignition plug includes an assembly step of assembling components, excluding the cap member 11, into the metallic shell 1; a gap adjustment step of, after the assembly step, adjusting the gaps G between the circumferential surface of the center electrode 3 and the ground electrodes 6 to a prescribed range; and an ignition chamber forming step of, after the gap adjustment step, forming the ignition chamber 4 at the front end of the metallic shell 1 by attaching the cap member 11 to the front end opening 10 of the metallic shell 1.

In the assembly step, the metallic shell 1, the insulator 2, and the center electrode 3 are assembled together by a known method, and no limitation is imposed on the method and order of assembling these components. Upon completion of the assembly, the ground electrodes 6 fixed to the wall surface of the ignition chamber 4 of the metallic shell 1 face the circumferential surface of the center electrode 3 located in the ignition chamber 4 of the metallic shell 1. Since the cap member 11 has not yet been attached to the front end opening 10 of the metallic shell 1 when the assembly step is completed, the front end of the ignition chamber 4 is open as shown in FIG. 3.

In the gap adjustment step, a tool such as a gap gauge is inserted from the front end opening 10 of the metallic shell 1 so as to measure the size of each gap G. When the size of a certain gap G falls outside the prescribed range, a corresponding ground electrode 6 is bent so as to adjust the gap G to the prescribed range.

Figure 55:
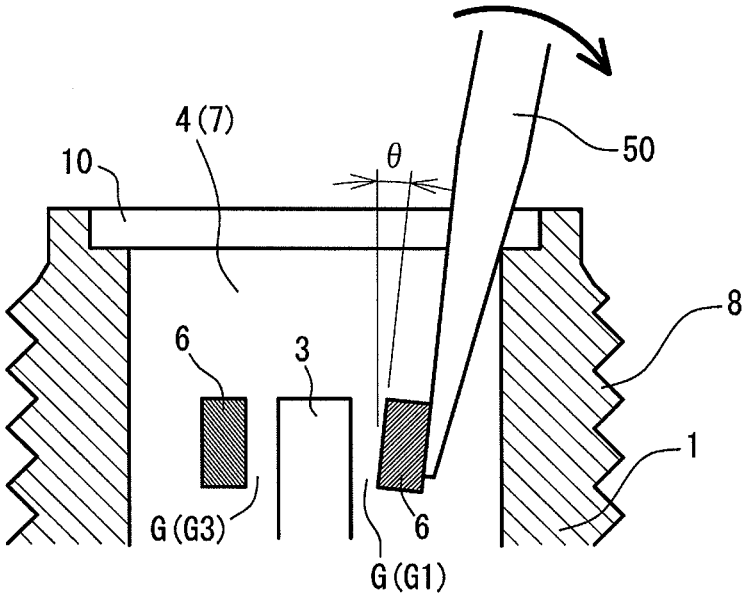
FIG. 55 is a sectional view of the main portion showing a state in which gap adjustment is performed through use of a rod-shaped tool.

Specifically, as shown in FIG. 55, a rod-shaped tool 50 is inserted from the front end opening 10 of the metallic shell 1 so as to apply a load to the ground electrode 6 at a position near the fixed end of the ground electrode 6 to thereby greatly displace the free end thereof. Thus, the size of the gap G is adjusted. Alternatively, a load is applied to the free end of the ground electrode 6 so as to finely adjust the size of the gap G.

Figure 9:
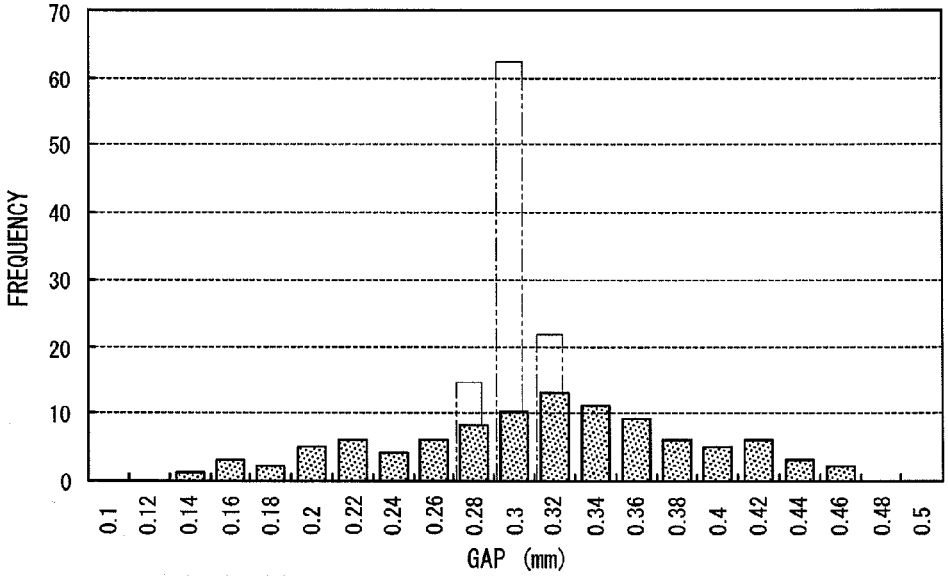
FIG. 9 is a graph showing the measured sizes of the gaps of 25 four-pole ignition plugs.¥

Such a gap adjustment step was performed for 25 ignition plugs (the number of poles=4), and the sizes of 100 gaps G in total were measured. The results of the measurement are shown by imaginary lines in the above-mentioned graph of FIG. 9. These results demonstrate that the ignition plugs of the first embodiment are excellent in stability and reliability, because the sizes of the gaps G fall within the prescribed range.

In the ignition chamber forming step, the cap member 11 is fitted into the front end opening 10 of the metallic shell 1, and is welded thereto, whereby the ignition chamber 4 is formed.

Next, there will be described the axial position of the ground electrodes 6 within the ignition chamber 4.

Since the ignition plug of the present invention is configured to enable a tool to be inserted from the front end opening 10 of the metallic shell 1 so as to adjust the gaps G, the ground electrodes 6 may be provided at the same position as the front end surface of the metallic shell 1 (that is, a position where the shortest axial distance L between the front end surface of the metallic shell 1 and the ground electrodes 6 is 0 mm) or any position within the ignition chamber. In order to clarify the relation between the axial position of the ground electrodes 6 within the ignition chamber 4 and the work time required for adjusting the gaps G, there were compared 30 ignition plugs in which the shortest distance L was set to 3 mm (plug E) and 30 ignition plugs in which the shortest distance L was set to 0 mm (plug G). The number of ground electrodes (poles) was 4. Table 3 shows the result of comparison.

TABLE 3

| Differences in work time required for gap adjustment (4 poles, 30 pieces, gap prescribed value: 0.3 ± 0.003 mm) | | | |
|---|---|---|---|
| | Specifications of ground electrode | Material of ground electrode | working time |
| Plug E | T = 1 mm, W = 2 mm ($I = 0.17\ mm^4$), L = 3 mm | Pt—20Ir (hardness: 300 MHV) | 30 min |
| Plug G | T = 1 mm, W = 2 mm ($I = 0.17\ mm^4$), L = 0 mm | Pt—20Ir (hardness: 300 MHV) | 10 min |

This result demonstrates that the closer the axial position of the ground electrodes 6 within the ignition chamber 4 to the front end surface of the metallic shell 1, the easier the gap adjustment work, and that the gap adjustment can be performed at a high speed sufficient for mass production even when the ground electrodes 6 are joined to a position determined such that the shortest axial distance L between the front end surface of the metallic shell 1 and the ground electrodes 6 becomes 3 mm or greater. Notably, the closer the axial position of the ground electrodes 6 within the ignition chamber 4 to the front end surface of the metallic shell 1, the greater the influence of heat on the ground electrodes 6. Therefore, the above-described configuration which enables gap adjustment to be performed for the ground electrodes 6 joined to a position shifted from the front end surface by 3 mm or more has a great technical significance.

Ignition plugs were manufactured on a trial basis in order to clarify the relation between the axial position of the ground electrodes 6 within the axial chamber 4 and the separation of the joint portion caused by heat. Specifically, there were manufactured an ignition plug in which the distance M (see FIG. 3) between the ground electrodes 6 and the start point (a point from which threading is started) of the screw shaft portion 8 of the metallic shell 1, the start point being located at the front end with respect to the axial direction, was set to 0 mm (plug H), an ignition plug in which the distance M was set to 3 mm (plug I), an ignition plug in which the distance M was set to 5 mm (plug J). The influence of heat on the joint portion was checked for these ignition plugs. Table 4 shows the check results.

TABLE 4

| Influence of joint position (ground electrodes: thickness 1.0 mm, Pt—20Ir) | | | |
|---|---|---|---|
| | Plug H | Plug I | Plug J |
| Joint position M (mm) | 0 | 3 | 5 |
| Joint portion temperature (° C.) | 400 | 200 | 130 |
| Separation of joint portion after 2000 hours | X (Separation occurred) | ○ (No separation) | ○ (No separation) |

These results demonstrate that, by shifting the joining/fixing position of the ground electrodes 6 from the start point of the screw shaft portion 8 of the metallic shell 1 by 3 mm or greater, the joined and fixed portions of the ground electrodes 6 become unlikely to be exposed to high temperature, and separation due to high temperature hardly occurs.

Next, for the prechamber plug, there will be described the relation between ignition performance and the sizes (volumes or areas), layout, etc. of the ignition chamber 4 and the ground electrodes 6.

Figure 10A:
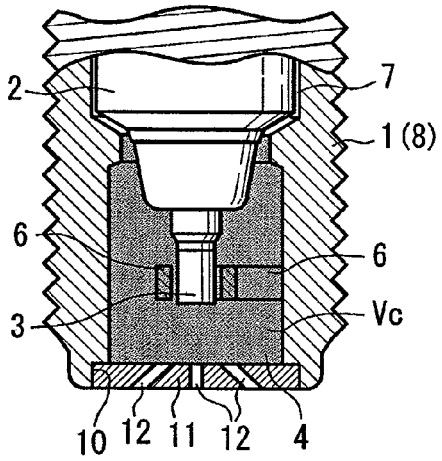
FIG. 10*a* is a main-portion sectional view showing the volume Vc of the ignition chamber.
Figure 10B:
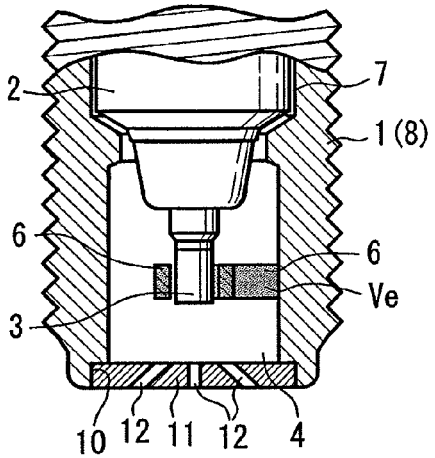
FIG. 10*b* is a main-portion sectional view showing the volume Ve of the ground electrodes.
Figure 10C:
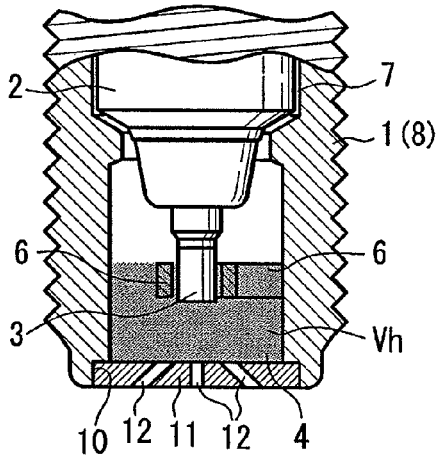
FIG. 10*c* is a main-portion sectional view showing the volume Vh of a region of the ignition chamber extending frontward from the rear end surfaces of the ground electrodes.
Figure 12:
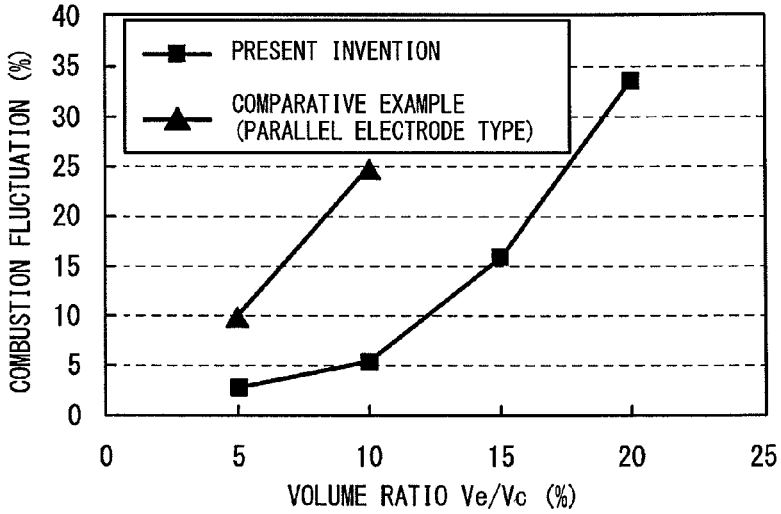
FIG. 12 is a graph showing the relation between volume ratio Ve/Vc and combustion fluctuation.

First, a satisfactory ignition performance can be obtained by setting the ratio of the volume Ve (see FIG. 10(*b*)) of portions of the ground electrodes 6 projecting into the ignition chamber 4 to the volume Vc (see FIG. 10(*a*)) of the ignition chamber 4 to 10% or less. This can be confirmed from the graph of FIG. 12 showing the relation between the volume ratio and combustion fluctuation. The combustion fluctuation is a variation ratio of IMEP (indicated means effective pressure) obtained from combustion pressure, and can be obtained in accordance with a formula (the combustion fluctuation)=(standard deviation/average)×100(%). This combustion fluctuation becomes low when the ignition performance is good. When the combustion fluctuation is 10% or less, the ignition performance of the ignition plug can be determined to be satisfactory.

The graph of FIG. 12 shows combustion fluctuations measured as follows. Prechamber plugs having the structure shown in FIG. 1 were manufactured, while the volume ratio Ve/Vc was varied among 5%, 10%, 15%, and 20%. The manufactured prechamber plugs were attached to an actual internal combustion engine, which was then operated at 1800 rpm and 500 kW. The combustion fluctuations of the prechamber plugs were measured in such a state. The graph of FIG. 12 demonstrates that, when the volume ratio Ve/Vc is 10% or less, stable ignition is attained because the combustion fluctuation is far below 10%.

Notably, for comparison, a similar test was carried out for a parallel-electrode-type prechamber plug having a ground electrode facing the front end surface of the center electrode 3 in parallel thereto. As is apparent from the graph of FIG. 12, a satisfactory result was not obtained, unlike the prechamber plug of the present invention. In such a parallel-electrode-type prechamber plug, conceivably, the ground electrode 6 prevents flame from spreading, and, therefore, a satisfactory flame jet cannot be obtained.

Figure 11A:
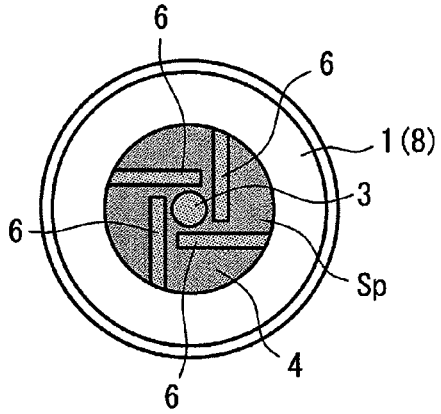
FIG. 11*a* is a sectional view showing the cross-sectional area Sp of the ignition chamber.
Figure 11B:
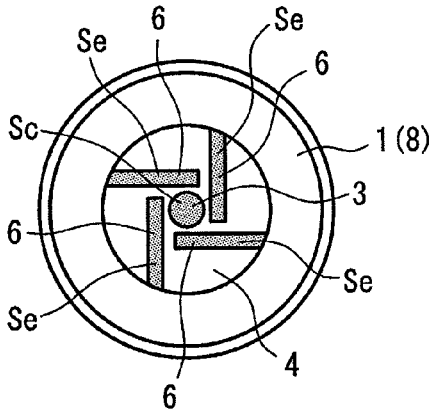
FIG. 11*b* is a sectional view showing the area Se of the ground electrodes and the area Sc of the center electrode.

Next, a satisfactory ignition performance can be obtained by setting the ratio of a total electrode area Sec—which is the sum of the area Se (see FIG. 11(*b*)) of the ground electrodes 6 (as measured on a cross section of the ignition chamber 4 crossing the ground electrodes 6 in the radial direction) and the area Sc (see FIG. 11(*b*)) of the center electrode 3 (as measured on the cross section)—to the area Sp (see FIG. 11(*a*)) of the cross section of the ignition chamber 4 to 50% or less, and by setting the ratio of the volume Vh (see FIG. 10(*c*)) of a portion of the ignition chamber 4 extending frontward from the rear end surfaces of the ground electrodes 6 to the volume Vc (see FIG. 10(*a*)) of the ignition chamber 4 to 50% or greater. This can be confirmed from the graph of FIG. 13, which shows the relation between the area ratio and combustion fluctuation.

Figure 13:
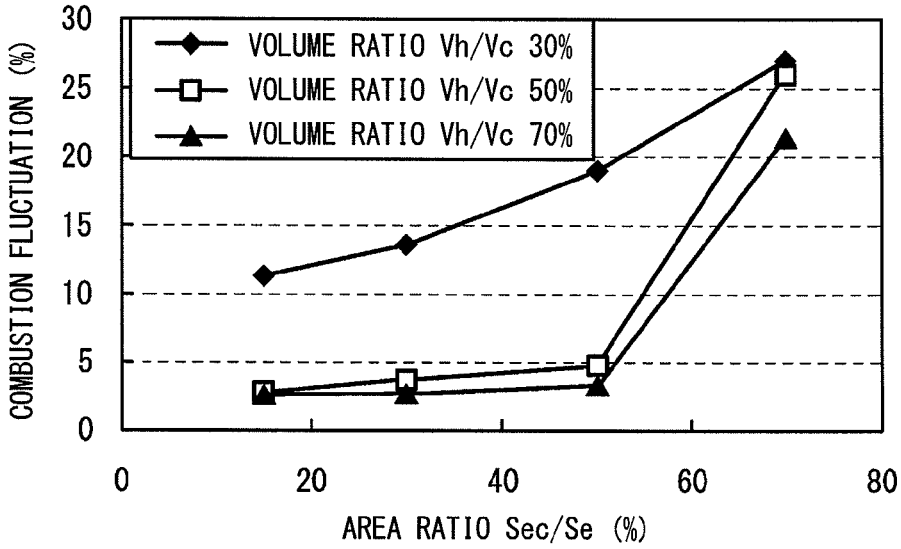
FIG. 13 is a graph showing the relation between area ratio Sec/Sp and combustion fluctuation.
Figure 14:
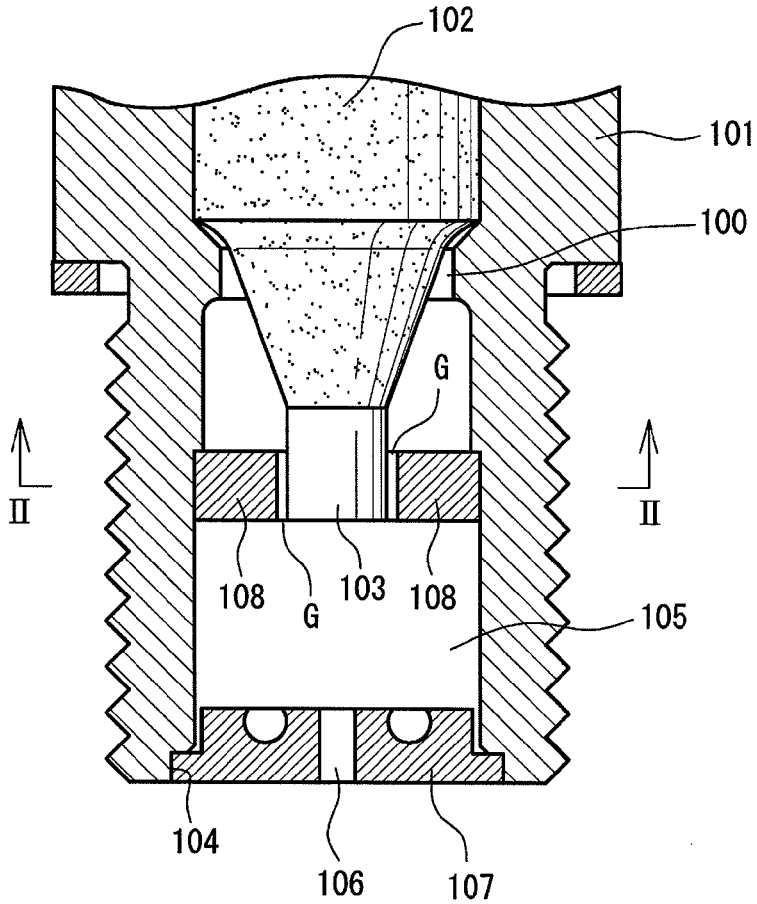
FIG. 14 is an enlarged sectional view of a main portion of a conventional ignition plug.
Figure 15:
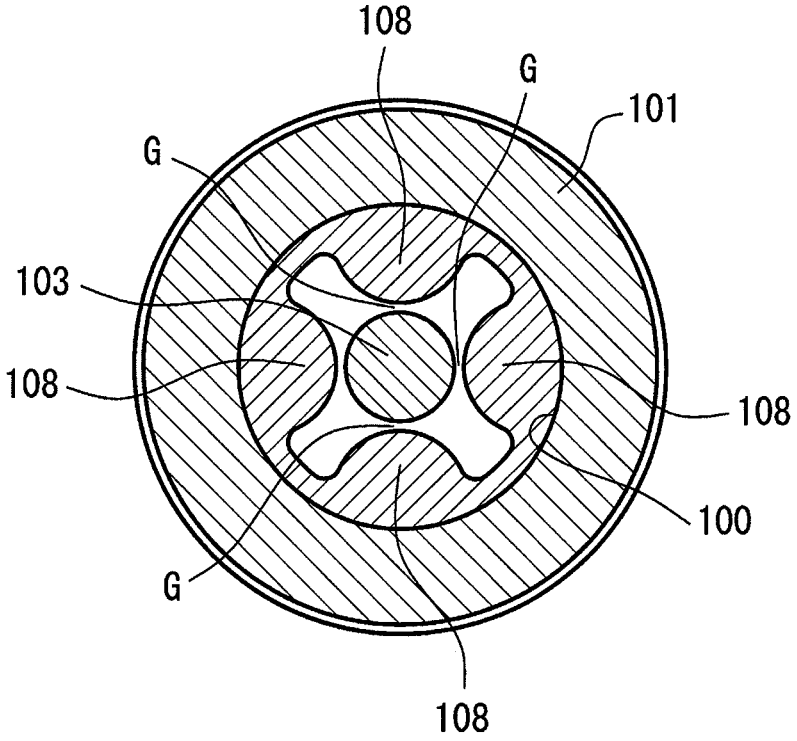
FIG. 15 is a sectional view taken along line II-II of FIG. 14.

That is, the graph of FIG. 13 shows combustion fluctuations measured as follows. Prechamber plugs having the structure shown in FIG. 1 were manufactured, while the area ratio Sec/Se was varied among 15%, 30%, 50%, and 70%. The manufactured prechamber plugs were attached to an actual internal combustion engine, which was then operated at 1800 rpm and 500 kW. The combustion fluctuations of the prechamber plugs were measured in such a state. This test was carried out for three types of prechamber plugs; i.e., those whose volume ratio Vh/Vc was 30%, those whose volume ratio Vh/Vc was 50%, and those whose volume ratio Vh/Vc was 70%. The graph of FIG. 13 demonstrates that, when the area ratio Sec/Se is equal to or less than 50% and the volume ratio Vh/Vc is equal to or greater than 50%, combustion fluctuation becomes far below a target value, whereby ignition becomes stable. This is because, when the area ratio and the volume ratio satisfy the above-described conditions, conceivably, a satisfactory flame jet can be generated. Specifically, when an unburned air-fuel mixture is taken into the ignition chamber 4, the unburned air-fuel mixture can be sufficiently taken into the space of the volume Vh extending to the ground electrodes 6, and the burned air-fuel mixture remaining in the ignition chamber 4 can be pushed into a space at a deeper position via openings between the ground electrodes 6, the openings having a total area equal to (the area Sp−the area Sec). Therefore, a satisfactory flame jet can be generated. In contrast, when the above-described conditions are not satisfied; that is, the volume ratio Vh/Vc is less than 50% and the area ratio Sec/Se is greater than 50%, conceivably, the pushing at the time when the unburned air-fuel mixture is introduced into the ignition chamber 4 becomes insufficient, and a high EGR state is created at the ignition position, whereby the ignition performance deteriorates.

Notably, the areas and volumes of the ignition chamber 4, etc. can be obtained by various methods such as a method of actually measuring the areas and volumes by cutting each product, and a method of charging a liquid into each product and measuring the amount of the charged liquid.

The first embodiment of the present invention has been described; however, the present invention is not limited to the first embodiment.

Figure 8:
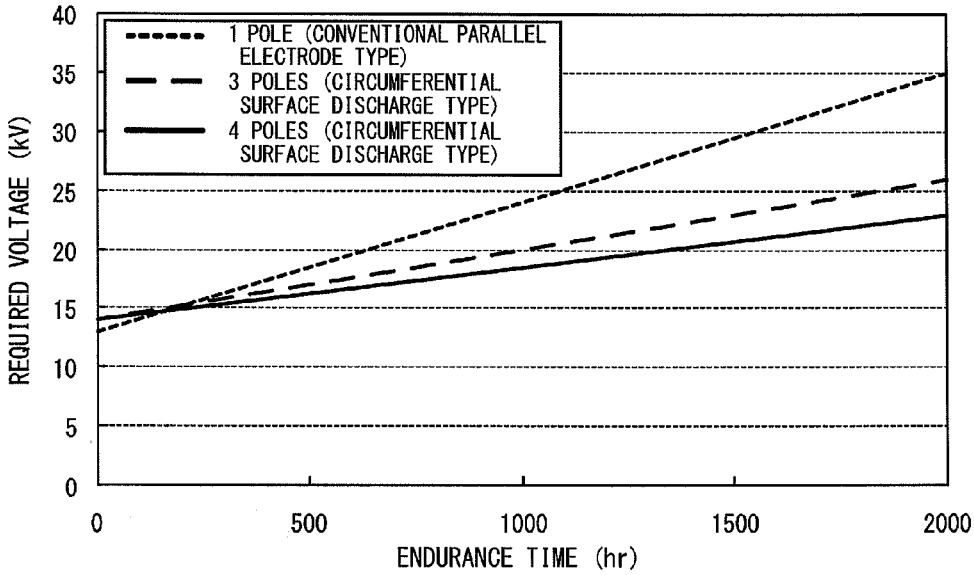
FIG. 8 is a graph showing the relation between the number of the ground electrodes (poles) and durability of the ignition plug.

For example, in the first embodiment, the four ground electrodes 6 are disposed in the ignition chamber 4 at equal intervals. However, the number of the ground electrodes 6 may be any number (including 1) so long as the space allows. As shown in the graph of FIG. 8, the durability of the ignition plug improves with the number of the ground electrodes. Meanwhile, since the time required for adjusting the gaps G apparently increases with the number of the ground electrodes 6 of the ignition plug, the present invention can provides a greater advantage for a multi-pole ignition plug which is large in the number of the ground electrodes 6.

Figure 7:
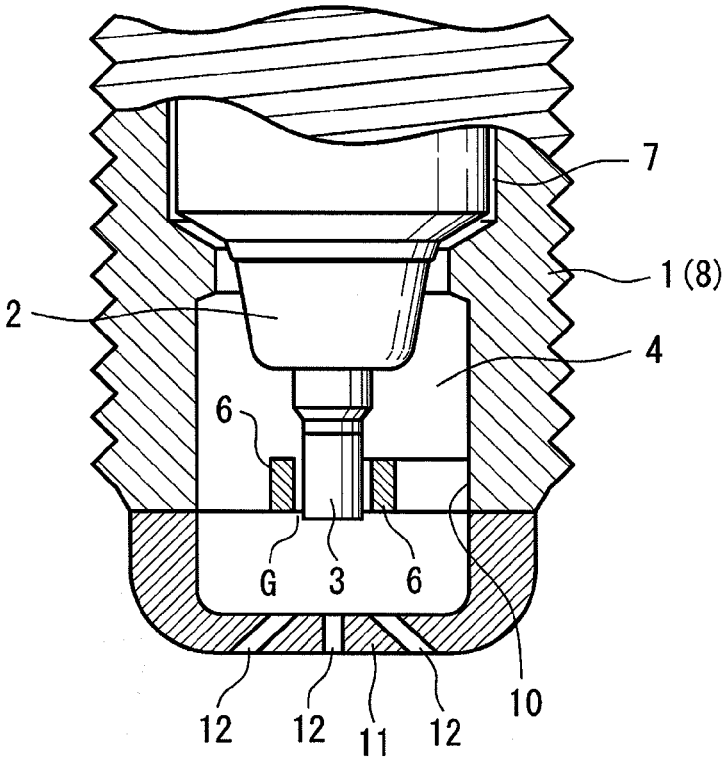
FIG. 7 is an enlarged sectional view of a main portion of the ignition plug showing a dome-like cap member.

Furthermore, in the first embodiment, the cap member 11, which closes the front end opening 10 of the metallic shell 1 is formed into a disk-like shape. However, as shown in FIG. 7, the cap member 11 may be formed into a dome shape. Also, no restriction is imposed on the size, direction, and shape of the holes 12 formed in the cap member 11 used in the present embodiment.

Second Embodiment

Next, a second embodiment of the present invention will be described with reference to FIGS. 16 to 44. Notably, an object of the second embodiment of the present invention is to provide an ignition plug in which separate ground electrodes are joined to a metallic shell and which is improved in the joint strength and durability of the ground electrodes, and a manufacturing method which enables manufacture of such an ignition plug.

Basic Structure of the Second Embodiment

Figure 16:
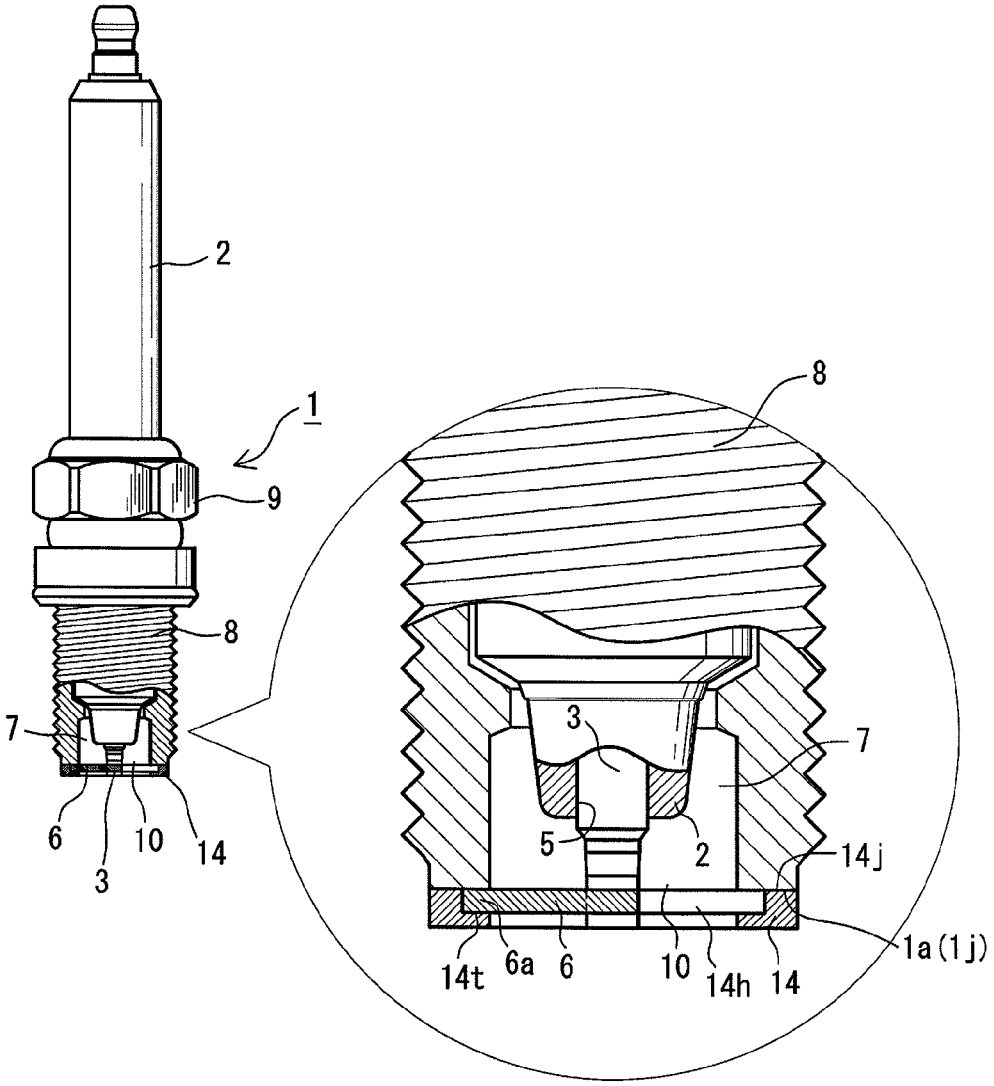
FIG. 16 is a partially sectioned front view of an ignition plug including a partial enlarged view.

As shown in FIG. 16, the ignition plug of the second embodiment includes a metallic shell 1; an insulator 2 attached to the metallic shell 1; a center electrode 3 attached to the insulator 2; ground electrodes 6 whose proximal end portions 6*a* are disposed at a front end portion of the metallic shell 1 (on the side where the center electrode 3 is disposed) and whose distal end portions face the circumferential surface of the center electrode 3 directly or indirectly with gaps G formed therebetween; and a metal fitting 14 disposed adjacent to the proximal end portions 6*a* of the ground electrodes 6.

The metallic shell 1 is a tubular member which has a through hole 7 extending therethrough in the axial direction thereof, and is formed of, for example, low carbon steel, which is an iron ally, or an Ni alloy. The metallic shell 1 has, at its front end with respect to the axial direction, a screw shaft portion 8, which is screwed into a plug attachment hole (not shown) of a cylinder head or the like. Also, the metallic shell 1 has, at its rear end, a tool engagement portion 9, with which a plug wrench is engaged.

The insulator 2 is a tubular member which has an axial hole 5 extending in the axial direction and which is formed of, for example, alumina. A front portion of the insulator 2, whose length is slightly smaller than half the entire length, is inserted into the through hole 7 from the rear end side of the metallic shell 1, whereby the insulator 2 is attached to the metallic shell 1.

The center electrode 3 is a solid round bar attached to the axial hole 5 of the insulator 2. The distal end surface of the center electrode 3 projects from the front end opening 10 of the metallic shell 1 by an amount approximately equal to the thickness of the metal fitting 14.

Figure 17:
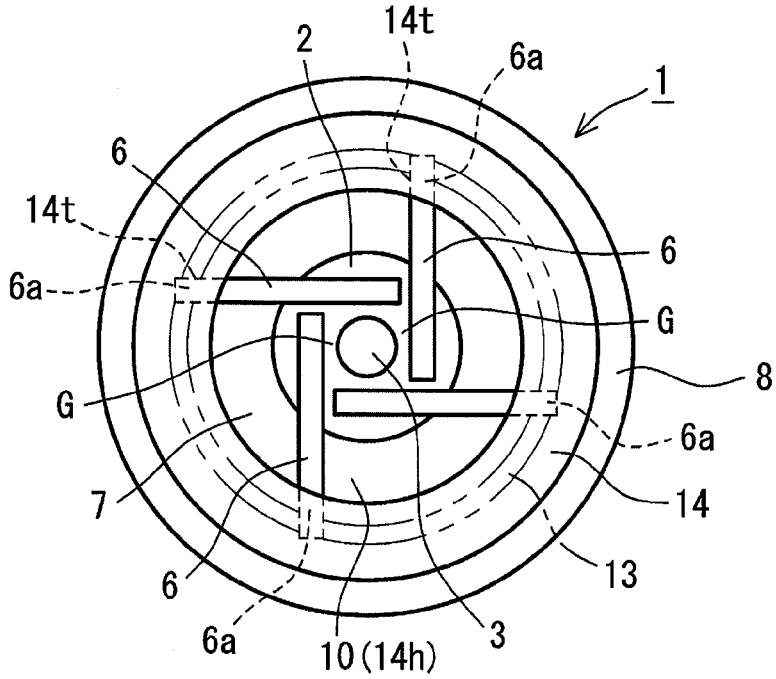
FIG. 17 is a front view of the ignition plug as viewed from the front end side.
Figure 18:
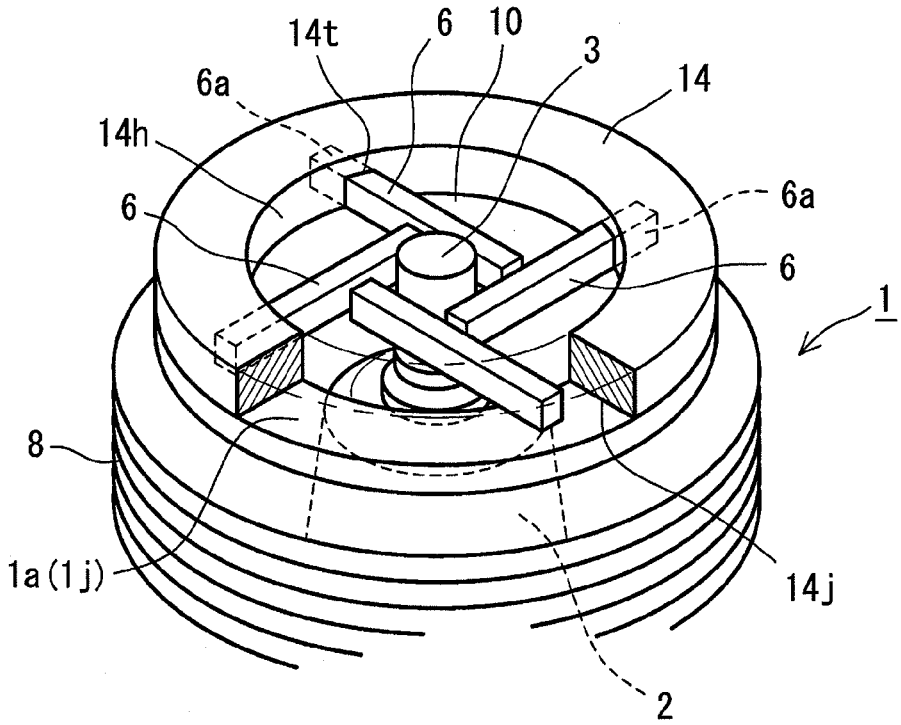
FIG. 18 is a perspective view of a main portion of the ignition plug as viewed from the front end side.

Each ground electrode 6 is a quadrangular bar having a rectangular cross section, and is formed of, for example, a Pt alloy or an Ir alloy. As shown in FIGS. 17 and 18, the proximal end 6*a* of the ground electrode 6 is disposed on a circular front end surface 1*a* of the metallic shell 1 such that the cantilevered ground electrode 6 extends in a chord direction of the front end surface 1*a*, and the free end of the ground electrode 6 faces the circumferential surface of the center electrode 3 directly or indirectly, with a gap G (see FIG. 17) formed therebetween. The illustrated ground electrodes 6 face the circumferential surface of the center electrode 3 directly. However, as in the case of the first embodiment, the ground electrodes 6 may be disposed to face the circumferential surface of the insulator 2 directly such that the ground electrodes 6 face the circumferential surface of the center electrode 3 indirectly. In such a case, spark discharge propagates along the surface of the insulator 2 to the center electrode 3 (creeping discharge).

The metal fitting 14 assumes the form of a flat washer, and is formed of the same material as the metallic shell 1; that is, low carbon steel, which is an iron ally, or an Ni alloy. The metal fitting 14 has an outer diameter equal to that of the front end surface 1*a* of the metallic shell 1, and has a hole 14*h* at the center thereof. The hole 14*h* has a diameter equal to the inner diameter of the front end surface 1*a* of the metallic shell 1. A surface of the metal fitting 14 which faces the metallic shell 1 and serves as a joint surface 14*j* is fixed to the front end surface 1*a* of the metallic shell 1; that is, a joint surface 1*j* of the metallic shell 1, by joint means such as welding. Grooves 14*t* for joining are provided on the joint surface 14*j* of the metal fitting 14 so as to receive the proximal end portions 6*a* of the ground electrodes 6. The proximal end portions 6*a* of the ground electrodes 6 are press-fitted into the grooves 14*t* or brazed or welded thereto, whereby the ground electrodes 6 are joined to the metal fitting 14. Accordingly, the proximal end portions 6*a* of the ground electrodes 6 are fixedly held between the metal fitting 14 and the metallic shell 1. The joint area between the joint surfaces 1*j* and 14*j* of the metallic shell 1 and the metal fitting 14 is set such that the joint area is equal to or greater than the joint area between the ground electrodes 6 and the metallic shell 1. Thus, a sufficiently high joint strength can be secured between the metallic shell 1 and the metal fitting 14.

Figure 19:
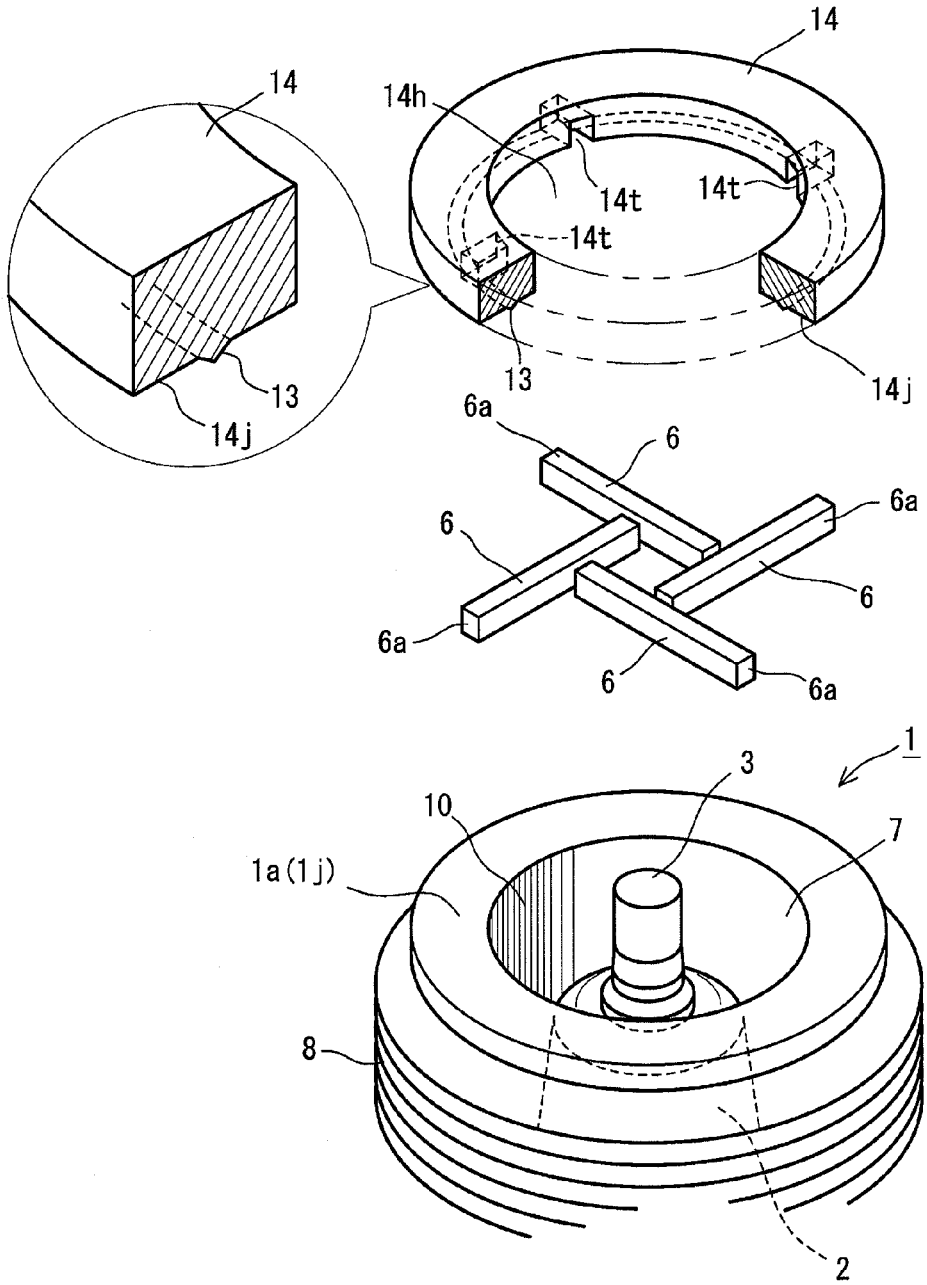
FIG. 19 is a exploded perspective view of the main portion of the ignition plug as viewed from the front end side.

In addition, as shown in FIG. 19, an annular protrusion 13 having a triangular cross section projects from the joint surface 14*j* of the metal fitting 14 such that its apex is directed toward the joint surface 1*j* of the metallic shell 1. This protrusion 13 enables the joint surfaces 1*j* and 14*j* of the metallic shell 1 and the metal fitting 14 to be reliably joined together by resistance welding, which will be described later.

Notably, when the protrusion 13 is projected on the joint surface 14*j* of the metal fitting 14 on which the protrusion 13 is provided, the projection area of the protrusion 13 becomes equal to the area of a portion of FIG. 17 sandwiched, i.e., defined, between two imaginary lines. The ratio of the projection area to the entire area of the joint surface 14*j* of the metal fitting 14 having the protrusion 13 is set to fall within a range of 15% to 50%. This range of the ratio of the projection area of the protrusion 13 to the area of the joint surface 14*j* is proved by the following joint strength test.

That is, the shape of the metal fitting 14 (material: low carbon steel) of the ignition plug was first determined such that the ratio of the projection area of the protrusion 13 to the area of the entire joint surface 14*j* became 5%, 15%, 25%, 40%, 50%, or 60%. Subsequently, in accordance with a manufacturing method to be described later, the metal fitting 14 having the ground electrodes 6 (material: Pt-20Ir alloy) joined thereto was joined to the metallic shell 1 (material: low carbon steel) by resistance welding. Next, instead of the insulator 2, a push rod for testing was inserted into the through hole 7 of the metallic shell 1 so as to press ground electrode 6 toward the metal fitting 14, to thereby measure the joint strength of the joint portion (hereinafter, a test performed by this method will be simply referred to as the "joint strength test").

Figure 31:
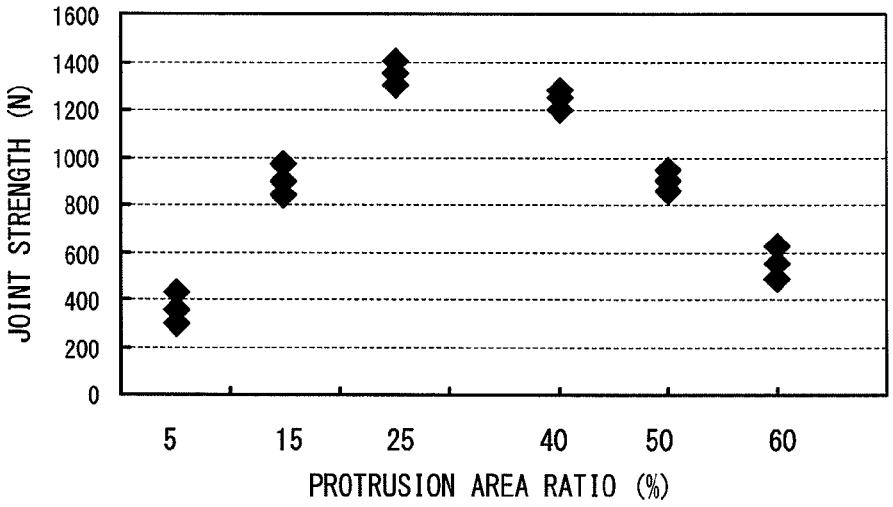
FIG. 31 is a graph showing the relation between the area ratio of a protrusion and the joint strength of the ground electrodes.

The graph of FIG. 31 shows the results of the joint strength test. The results demonstrate that, when the protrusion 13 is formed such that the above-mentioned ratio becomes 15% to 50%, a sufficiently high joint strength can be attained.

Next, a method of manufacturing the ignition plug will be described.

Figure 20:
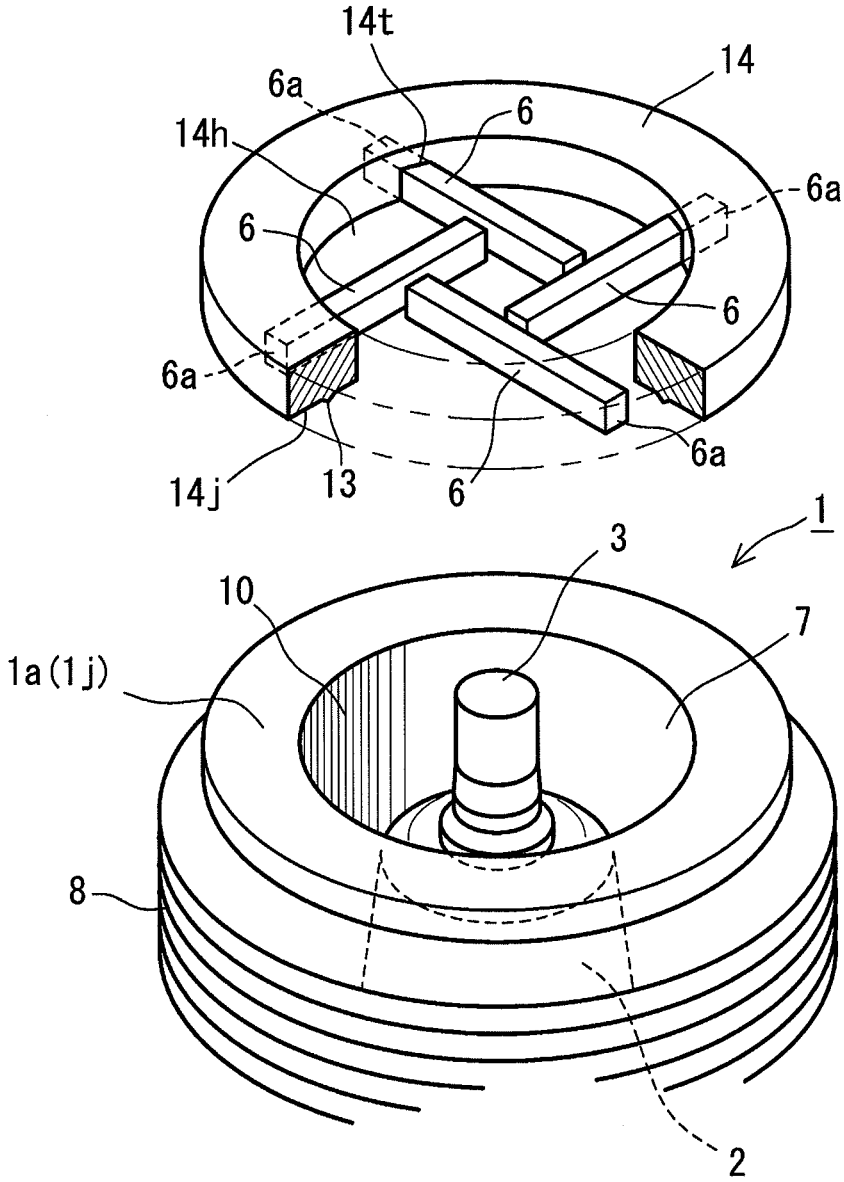
FIG. 20 is an exploded perspective view as viewed from the front end side which shows a step of manufacturing the ignition plug.
Figure 21:
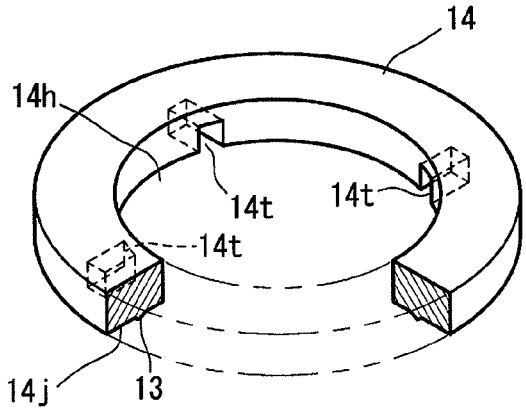
FIG. 21 is an exploded perspective view as viewed from the front end side which shows a step of manufacturing the ignition plug.
Figure 21:
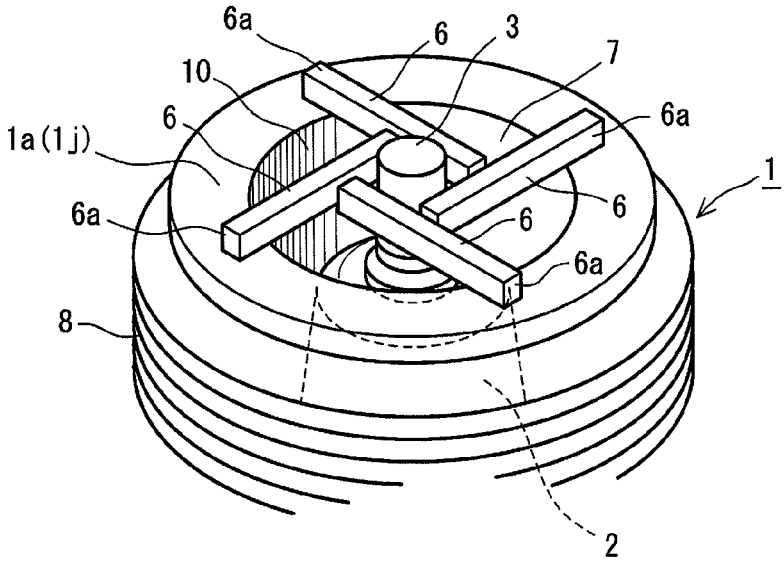

First, a process of manufacturing the ignition plug includes a conventional assembly step of assembling components, excluding the ground electrodes 6 and the metal fitting 14, into the metallic shell 1; and first and second steps performed after the assembly step. In the first step, as shown in FIG. 20, the ground electrodes 6 are press-fitted into the grooves 14*t* of the metal fitting 14, or are welded or brazed to the metal fitting 14 after being fitted into the grooves 14*t*, whereby all the ground electrodes 6 are fixed to the metal fitting 14. In the second step, as shown in FIG. 21, the metal fitting 14, to which the ground electrodes 6 have been fixed in the first step, is fixedly attached to the metallic shell 1 such that the ground electrodes 6 are disposed between the metal fitting 14 and the metallic shell 1.

The second step is comprised of a third step and a fourth step. In the third step, the metal fitting 14 to which the ground electrodes 6 have been fixed in the first step (see FIG. 20) is brought into contact with the front end surface 1*a* of the metallic shell 1. In the fourth step, the metal fitting 14, which has been brought into contact with the metallic shell 1 in the third step is joined to the metallic shell 1. The joining in the fourth step is performed by resistance welding; i.e., by supplying a current between the metallic shell 1 and the metal fitting 14 so as to melt and join the joint surfaces 1*j* and 14*j*. At that time, the current concentrates at the pointed portion of the protrusion 13 provided on the metal fitting 14, and the pointed portion is heated to a high temperature. Therefore, the welding is performed reliably, and consistent joint strength is attained.

Alternatively, the ignition plug can be manufactured by performing fifth and sixth steps, rather than the first through fourth steps, after the above-described assembly step. In the fifth step, as shown FIG. 21, the ground electrodes 6 are welded or brazed to the front end surface 1*a* of the metallic shell 1, whereby all the ground electrodes 6 are fixed to the metallic shell 1. In the sixth step, the metal fitting 14 is fixedly attached to the metallic shell 1, having the ground electrodes 6 fixed thereto in the fifth step, such that, as shown in FIG. 18, the ground electrodes 6 are disposed between the metal fitting 14 and the metallic shell 1.

The sixth step is comprised of a seventh step and an eighth step. In the seventh step, the metal fitting 14 is brought into contact with the metallic shell 1, to which the ground electrodes 6 have been fixed in the fifth step. In the eighth step, the metal fitting 14, which has been brought into contact with the metallic shell 1 in the seventh step, is joined to the metallic shell 1. Since this eighth step is identical with the above-described fourth step, its description will not be repeated.

Notably, in order to facilitate the description, in the fifth through eighth steps, the metallic shell 1 and the metal fitting 14 shown in FIG. 19 are used as they are. However, although not shown in the drawings, preferably, a protrusion and grooves for receiving the ground electrodes 6 are formed on the front end surface 1*a* of the metallic shell 1, and the metal fitting 14 is formed into the form of a simple flat washer. In this case, positioning of the ground electrodes 6 can be readily performed through use of the grooves of the metallic shell 1. In addition, since the metal fitting 14 assumes the form of a simple flat washer and has no directivity, the metal fitting 14 can be attached to the metallic shell 1 by simply placing the metal fitting 14 on the front end of the metallic shell 1. Therefore, workability is very good.

Figure 22:
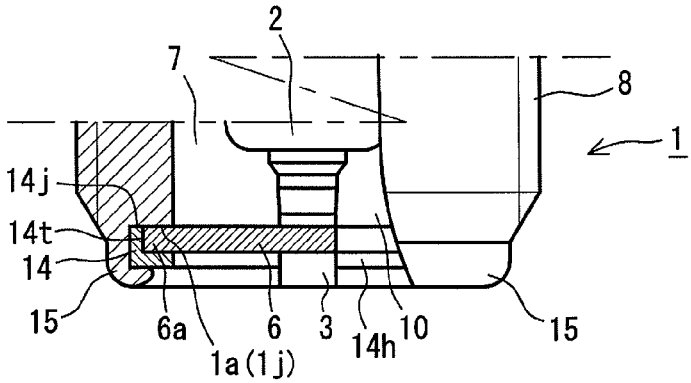
FIG. 22 is a partially-sectioned front view showing a main portion of another ignition plug.
Figure 23A:
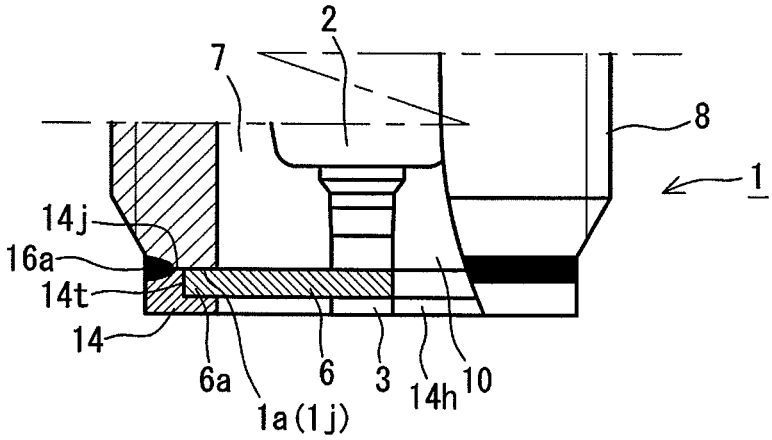
FIG. 23*a* and FIG. 23*b* are partially-sectioned front views showing main portions of other ignition plugs.
Figure 23B:
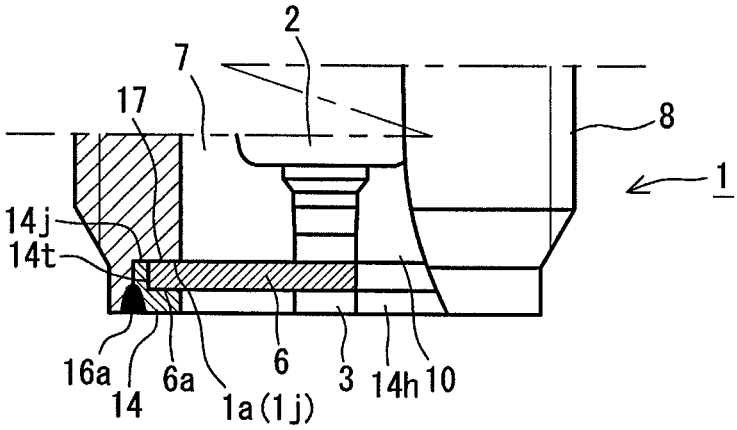

Although the above-described ignition plug can be manufactured by the above-described method, when the joint strength of the ground electrodes 6 is required to increase, a structure as shown in FIG. 22 may be employed. Specifically, a crimp portion 15 assuming the form of a short tube is provided along the outer circumference of the front end surface 1*a* of the metallic shell 1 such that the crimp portion 15 projects from the front end surface 1*a* and surrounds the metal fitting 14. The crimp portion 15 is crimped so as to fix the metal fitting 14. Alternatively, instead of providing such a crimp portion 15, a structure shown in FIG. 23(*a*) or a structure shown in FIG. 23(*b*) may be employed. In the structure shown in FIG. 23(*a*), the metallic shell 1 and the metal fitting 14 are laser-welded at a boundary region 16*a* therebetween. In the structure shown in FIG. 23(*b*), a recess 17 is formed on the front end surface 1*a* of the metallic shell 1, and the metal fitting 14 is fitted into the recess 17. In this state, the metallic shell 1 and the metal fitting 14 are laser-welded at a boundary region 16*a* therebetween.

Figure 32:
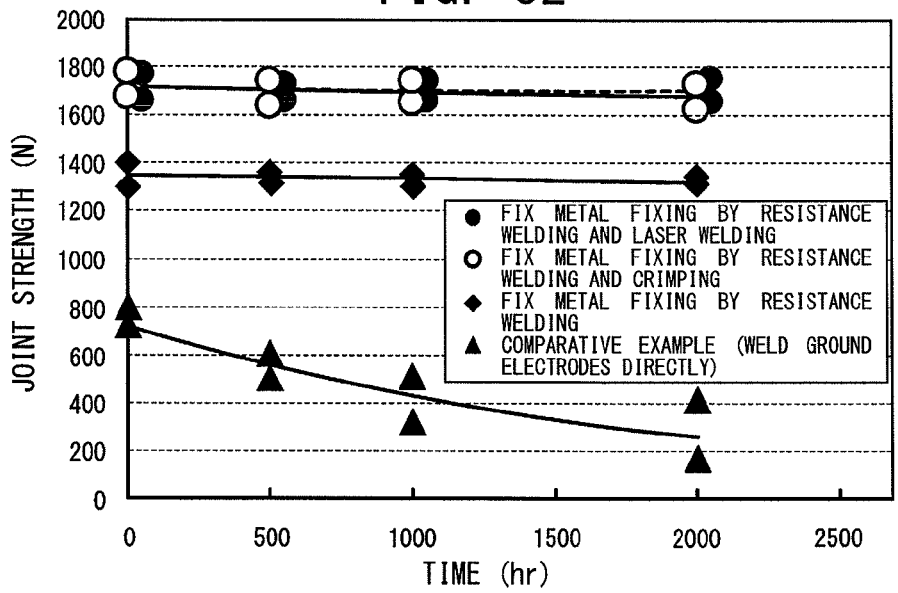
FIG. 32 is a graph showing the relation between the joint strength of the ground electrodes and operation time.
Figure 33:
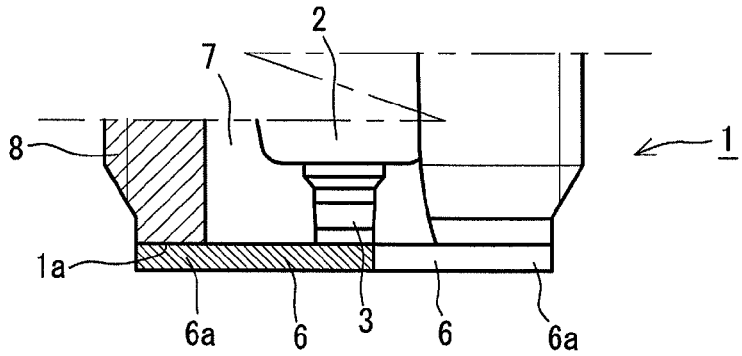
FIG. 33 is a sectional front view showing a main portion of an ignition plug which is shown as Comparative Example in the graph of FIG. 32.
Figure 34:
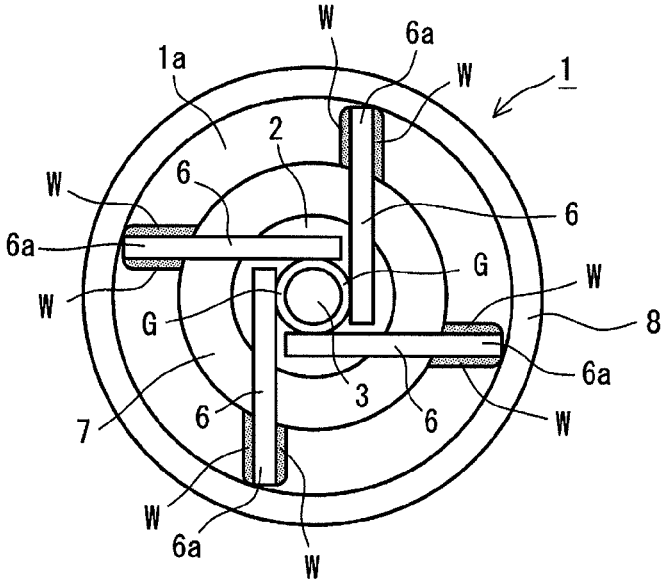
FIG. 34 is a front view of the ignition plug of FIG. 33 as viewed from the front end side.

The graph of FIG. 32 shows the results obtained by performing a test (identical with the above-described joint strength test on the joint portion of each ground electrode 6) for an ignition plug in which the metal fitting 14 was fixed to the metallic shell 1 through resistance welding, an ignition plug in which the metal fitting 14 was reinforced by the crimp portion 15, and an ignition plug in which the metal fitting 14 was reinforced by means of laser welding. Notably, for comparison, the same joint strength test was conducted for an ignition plug in which, as shown in FIGS. 33 and 34, the ground electrodes 6 formed of Pt-20Ir alloy were welded directly to the front end surface 1*a* of the metallic shell 1 formed of an iron alloy (see symbol W in FIG. 34). The result of this joint strength test is also shown in the graph of FIG. 32.

These results demonstrate that, after use for 2000 hours, the ignition plug in which the ground electrodes 6 are fixed by fixing the metal fitting 14 to the metallic shell 1 through resistance welding has a joint strength 4 to 5 times that of the ignition plug of Comparative Example in which the ground electrodes 6 are welded directly to the front end surface 1*a* of the metallic shell 1. Also, the results demonstrate that the joint strength of the ground electrodes 6 can be increased without fail by reinforcing the metal fitting 14 fixed to the metallic shell 1 by means of crimping or laser welding.

Figure 24:
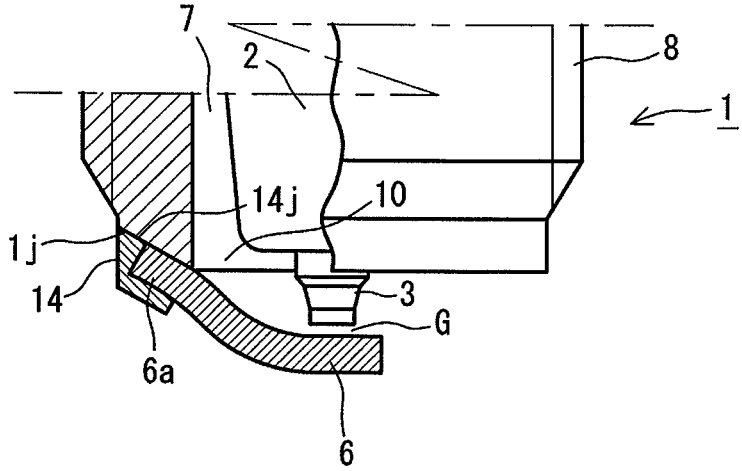
FIG. 24 is a partially-sectioned front view showing a main portion of another ignition plug.
Figure 25:
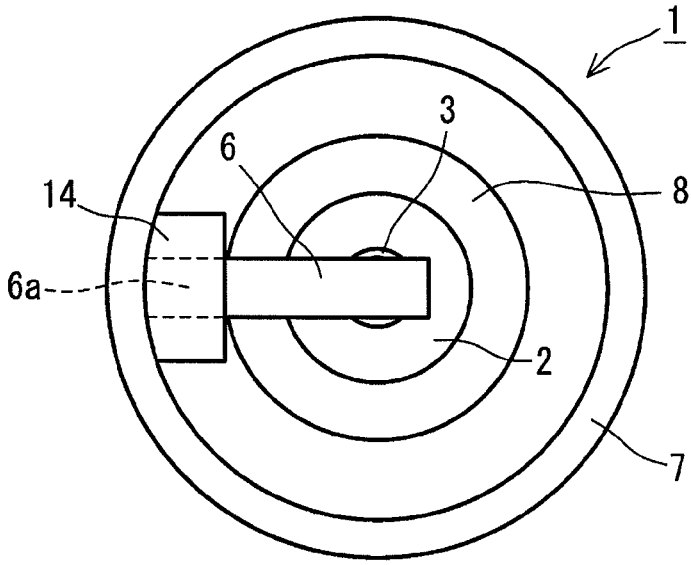
FIG. 25 is a front view of the ignition plug of FIG. 24 as viewed from the front end side.

The basic structure of the second embodiment has been described for an ignition plug having a plurality of ground electrodes 6. However, the basic structure of the second embodiment can be similarly applied to an ignition plug having a single ground electrode 6 as shown in FIGS. 24 and 25. In this case, the metal fitting 14 is not necessarily required to have the shape of a flat washer, and may have any shape as long as the metal fitting 14 can cover at least the proximal end portion 6*a* of the ground electrode 6.

FIGS. 26 to 30 show an ignition plug according to the second embodiment of the present invention. Notably, in FIGS. 26 to 30, components which are identical with or have the same functions as those of the basic structure are denoted by the same reference numerals as those used for the basic structure; and description of such components will not be repeated.

The ignition plug according to the second embodiment is a prechamber plug which has an ignition chamber 4 at a front end portion of the metallic shell 1. The distal end of the center electrode 3 is located rearward of the front end of the metallic shell 1, and the front end opening 10 is covered with a cap member 11.

The cap member 11 has holes 12 for establishing communication between the ignition chamber 4 and a combustion chamber of an internal combustion engine. An unburned air-fuel mixture is introduced from the combustion chamber into the ignition chamber 4 via the holes 12 and is ignited. A frame generated as a result of ignition of the air-fuel mixture is jetted from the holes 12 into the combustion chamber.

Figure 29:
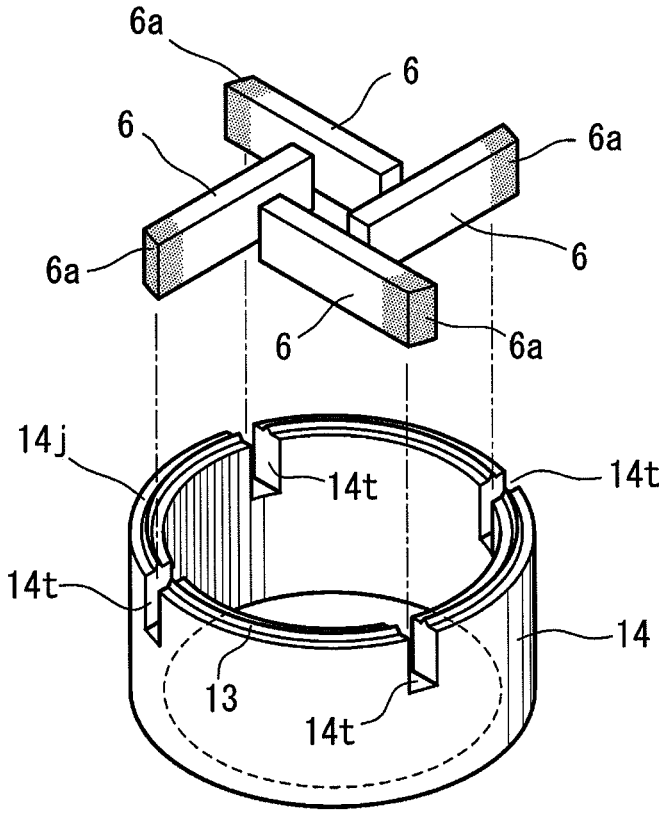
FIG. 29 is a perspective view showing a metal fitting and ground electrodes in an exploded state.

As shown in FIG. 29, the metal fitting 14 of the second embodiment has a cylindrical tubular shape, and is fitted into a diameter-increased hole 18 which assumes the form of a stepped hole and is formed in the front end portion of the metallic shell 1. A rear end portion of the metal fitting 14 has grooves 14*t* for receiving the proximal end portions 6*a* of the ground electrodes 6 to be joined, and a protrusion 13 for resistance welding. The rear end surface of the metal fitting 14, which serves as a joint surface 14*j*, butts against a step portion 19 of the diameter-increased hole 18 of the metallic shell 1, the step portion serving as a joint surface 1*j*. Accordingly, the ground electrodes 6 are joined in a state in which they are sandwiched between the step portion 19 of the metallic shell 1 and the rear end portion of the metal fitting 14 (including the bottoms of the grooves 14*t*).

Figure 30:
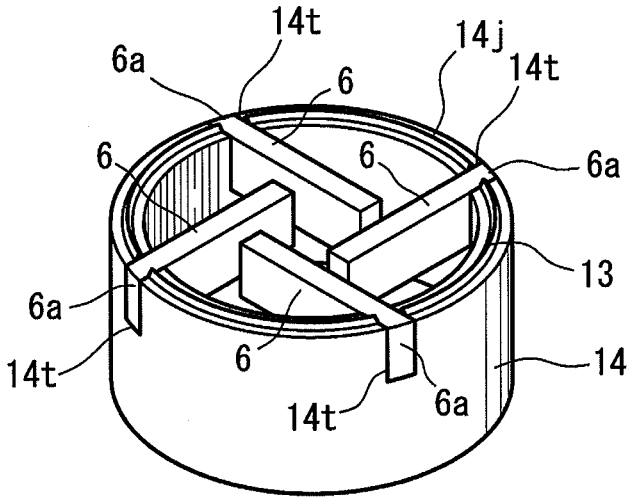
FIG. 30 is a perspective view showing a state in which the ground electrodes are joined to the metal fitting.

Notably, in the second embodiment, as shown in FIGS. 29 and 30, the grooves 14*t* for joining the ground electrodes 6, which are formed in the metal fitting 14, are open to the outside with respect to the radial direction. In the case where the grooves 14*t* of the metal fitting 14 are open to the outside with respect to the radial direction, the area of contract between each ground electrode 6 and the corresponding groove 14*t* becomes the maximum, and electric resistance can be reduced. Also, the grooves 14 open to the outside provide the following advantage. Heat transmitted to the ground electrodes 6 during operation of the internal combustion engine escapes to the main body of the internal combustion engine via the screw shaft portion 8 of the metallic shell 1. Since the grooves 14*t* of the metal fitting 14 are open to the outside with respect to the radial direction, the end surfaces of the proximal end portions 6*a* of the ground electrodes 6 come into direct contact with the metallic shell 1, whereby conduction of heat from the ground electrodes 6 to the screw shaft portion 8 can be performed efficiently. Accordingly, the ground electrodes 6 become less likely to be exposed to high temperature. This effect is also attained in the case where the grooves 14*t* of the metal fitting 14 of the basic structure are rendered open to the outside with respect to the radial direction.

The length of the metal fitting 14 as measured in the axial direction is rendered shorter than the length of the diameter-increased hole 18 by an amount corresponding to the thickness of the cap member 11. By virtue of this dimensional relation, when the metal fitting 14 is fitted into the metallic shell 1, a recessed opening step portion 20 is formed in the front end opening 10 of the metallic shell 1, and the cap member 11 is fixed to the opening step portion 20. Needless to say, in the case where the axial length of the metal fitting 14 is rendered the same as that of the diameter-increased hole 18 and the opening step portion 20 is not provided, an engagement step portion may be provided along the circumference of the cap member 11, and the cap member 11 may be fitted into the front end opening of the metal fitting 14.

Figure 26:
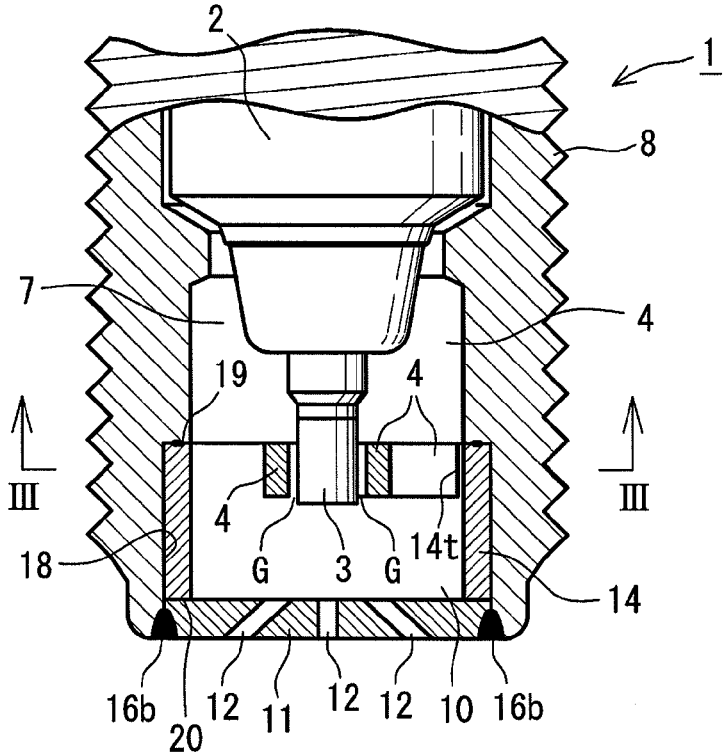
FIG. 26 is a sectional front view showing a main portion of a prechamber plug.

The prechamber plug is manufactured as follows. After the metallic shell 1, the ground electrodes 6, and the metal fitting 14 are attached and joined together in steps, which are substantially the same as those for the basic structure (the details of such a process will be described later), the gaps G of all the ground electrodes 6 are adjusted to a proper size in a gap adjustment step, and the cap member 11 is fixed to the metallic shell 1, whereby the manufacture of the prechamber plug is completed. As shown in FIG. 26, fixing of the cap member 11 to the metallic shell 1 can be performed by welding them together at the boundary region 16*b* through use of a laser or the like. Alternatively, although not illustrated, the cap member 11 can be fixed to the metallic shell 1 by crimping a crimp portion similar to that shown in FIG. 22, which is provided at the front end of the metallic shell 1.

Accordingly, in the second embodiment, the metal fitting 14 may be fixed to the metallic shell 1 through use of laser welding or the crimp portion 15 as in the case of the basic structure. Alternatively, the cap member 11 is fixed to the metallic shell 1 by welding them together at the boundary region 16*b* through use of a laser or the like, or by providing a crimp portion, whereby the metal fitting 14 is fixed to the metallic shell 1 via the cap member 11. Notably, needless to say, the test results of FIGS. 31 and 32 showing the relation between the fixing of the metal fitting 14 and the joint strength of the ground electrodes 6 also apply to the second embodiment.

Next, the details of the steps of attaching and joining the metallic shell 1, the ground electrodes 6, and the metal fitting 14 together in the second embodiment will be described. The steps include first and second steps. In the first step, as shown in FIGS. 29 and 30, the ground electrodes 6 are press-fitted into the grooves 14*t* of the metal fitting 14, or are welded or brazed to the metal fitting 14 after being fitted into the grooves 14*t*, whereby all the ground electrodes 6 are fixed to the metal fitting 14. In the second step, the metal fitting 14 to which the ground electrodes 6 have been fixed in the first step is fixedly attached to the metallic shell 1 such that the ground electrodes 6 are disposed between the metal fitting 14 and the metallic shell 1, as indicated by imaginary lines in FIGS. 18 and 20.

The second step is comprised of third and fourth steps. In the third step, the metal fitting 14 (see FIG. 30) to which the ground electrodes 6 have been fixed in the first step is placed in the diameter-increased hole 18 of the metallic shell 1, and the joint surface 14*j* (specially, the protrusion 13) of the metal fitting 14 is brought into contact with the joint surface 1*j* (the step portion 19) of the metallic shell 1 (see an imaginary line in FIG. 28). In the fourth step, the metal fitting 14, which has been brought into contact with the metallic shell 1 in the third step, is joined to the metallic shell 1.

In the second embodiment, resistance welding is employed in the fourth step. Specifically, as indicated by an imaginary line in FIG. 29, a round-bar-shaped welding jig 25 is pressed against the front end of the metal fitting 14, and a current is supplied from the welding jig 25 to a region between the metallic shell 1 and the metal fitting 14 so as to melt and join the joint surfaces 1*j* and 14*j*. At that time, in the second embodiment as well, the current concentrates at the pointed portion of the protrusion 13 provided on the metal fitting 14, and the pointed portion is heated to a high temperature. Therefore, the welding is performed reliably, and consistent joint strength is attained.

Also, the steps of attaching and joining the metallic shell 1, the ground electrodes 6, and the metal fitting 14 together in the second embodiment may differ from the above-described first to fourth steps; that is, may be fifth and sixth steps, which are not shown. In the fifth step, the ground electrodes 6 are welded to or brazed to the step portion 19 of the diameter-increased hole 18 of the metallic shell 1, whereby all the ground electrodes 6 are fixed to the metallic shell 1. In the sixth step, the metal fitting 14 is fixedly attached to the metallic shell 1, to which the ground electrodes 6 have been fixed in the fifth step, such that the ground electrodes 6 are disposed between the metal fitting 14 and the metallic shell 1.

The sixth step is comprised of seventh and eighth steps. In the seventh step, the metal fitting 14 is attached to the metallic shell 1, to which the ground electrodes 6 have been fixed in the fifth step. In the eighth step, the metal fitting 14, which has been attached to the metallic shell 1 in the seventh step is joined to the metallic shell 1. Since the eighth step of the second embodiment is identical with the fourth step of the second embodiment, its description will not be repeated.

Figure 28:
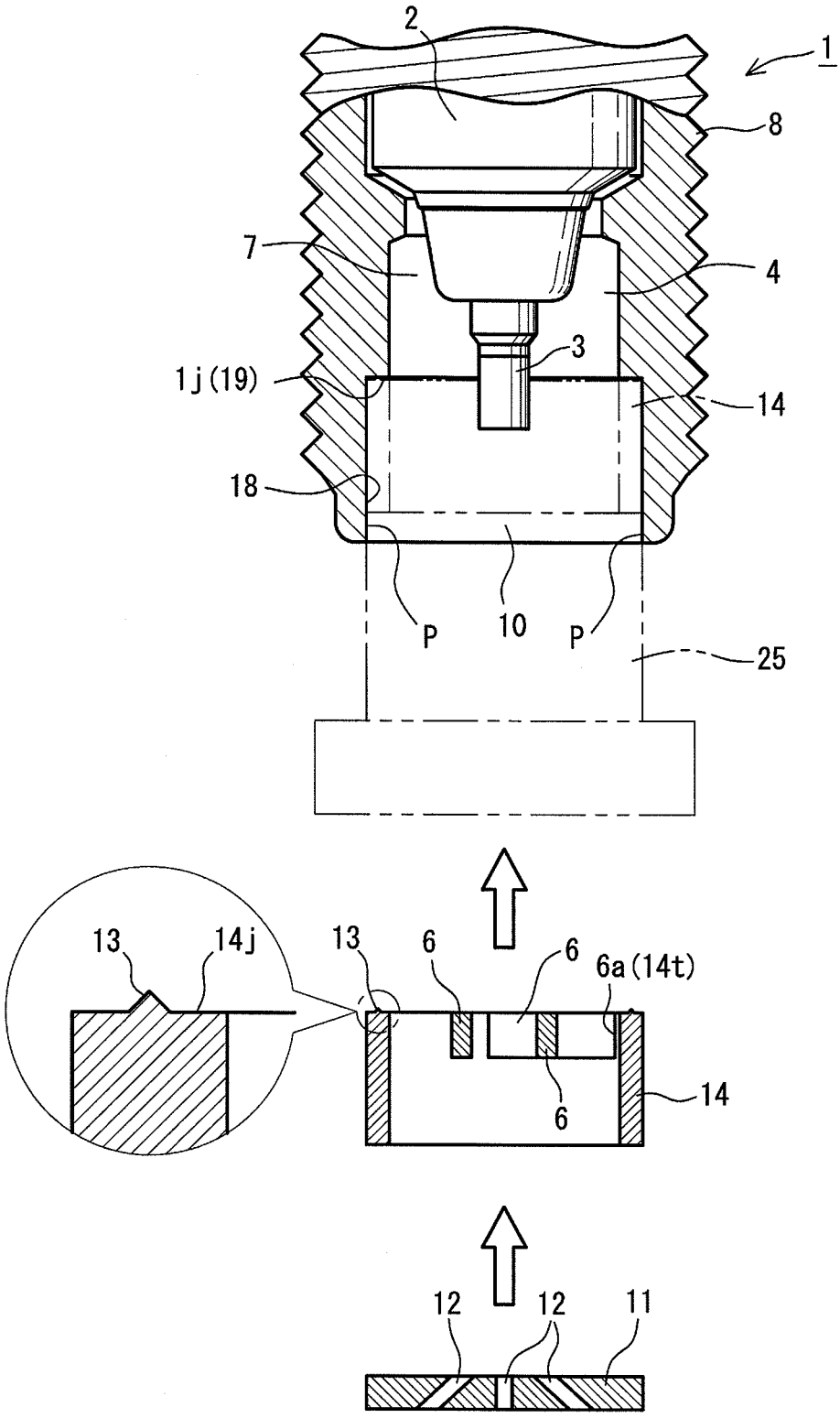
FIG. 28 is a sectional front view showing, in an exploded state, the main portion shown in FIG. 26.

Notably, a plurality of trial products having the structure shown in FIG. 28 were manufactured by attaching and joining the metallic shell 1, the ground electrodes 6, and the metal fitting 14 by the first to fourth steps of the second embodiment; and the above-described joint strength test was performed for the trial products. As indicated as "Comparative Example" in the graph of FIG. 44, the joint strength varied, and the joint strengths of some trial products were lower than a target joint strength (about 1300 N or greater).

The present inventors studied the cause, and found that the welding current which must flow through the joint surfaces 1*j* and 14*j* in a concentrated state, disperses and flows through other regions. In order to solve this problem, the present inventor has developed first through fifth technical means. The first through fifth technical means will be described below. Since the above-described phenomenon similarly occurs even in the case where the metallic shell 1, the ground electrodes 6, and the metal fitting 14 are attached and joined together by the fifth through eighth steps, needless to say, the first through fifth technical means apply to such a case as well.

First Technical Means

Figure 35:
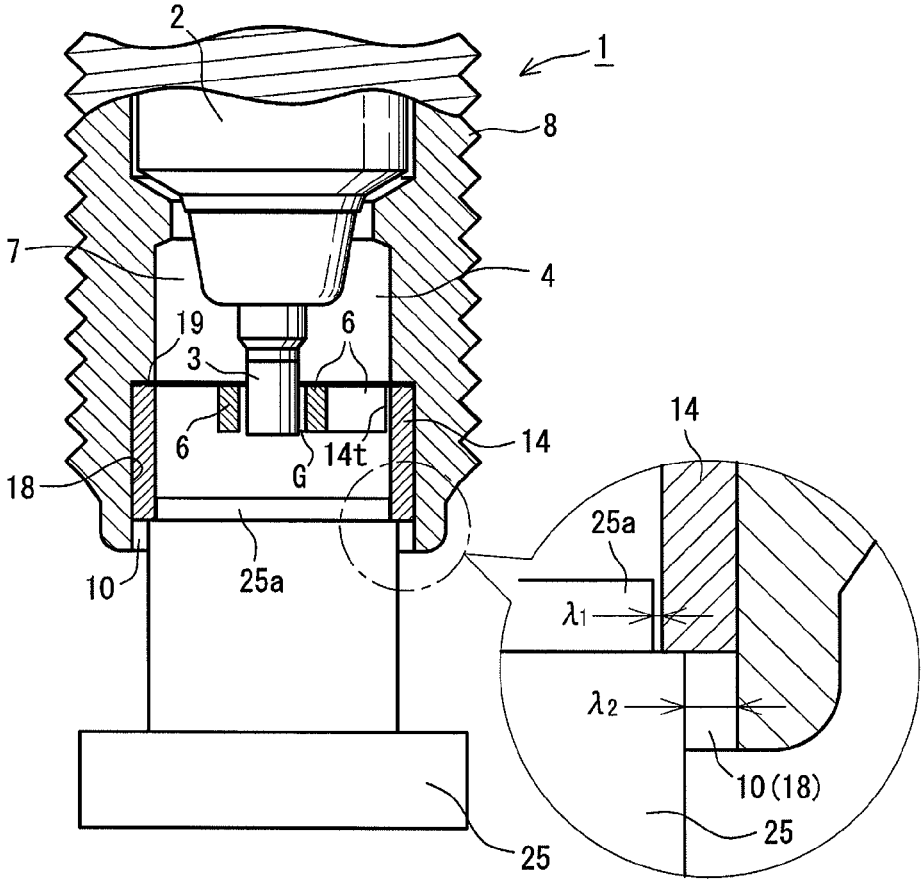
FIG. 35 is a vertical sectional view of a main portion of a prechamber plug showing a state at the time of resistance welding.

In some cases, the welding current flows to the metallic shell 1 via a contact area between the outer circumferential surface of the welding jig 25 and the wall surface of the diameter-increased hole 18 (see symbol P in FIG. 28). In view of this, as shown in FIG. 35, a convex portion 25*a*, which can be removably inserted into an end portion of the metal fitting 14, is formed at the end of the welding jig 25 so that the welding jig 25 assumes the form of a stepped round rod. The convex portion 25*a* is inserted into the metal fitting 14, and the welding jig 25 is positioned at the approximate center of the diameter-increased hole 18 with a clearance formed between the welding jig 25 and the wall surface of the diameter-increased hole 18. By virtue of this structure, the joining work can be performed by resistance welding; i.e., by supplying current to the metal fitting 14 while maintaining a state in which the contact between the welding jig 25 and the metallic shell 1 is broken (ninth step or tenth step).

In this case, as shown in the enlarged view of FIG. 35, a radius difference $\lambda_1$ (play) is provided between the convex portion 25*a* of the welding jig 25 and the metal fitting 14 so as to enable the convex portion 25*a* to be removably inserted into the metal fitting 14. Accordingly, a portion of the welding jig 25 which faces the inner circumferential surface of the metallic shell 1 (the wall surface of the diameter-increased hole 18) has a diameter determined such that a relation $\lambda_2>\lambda_1$ is satisfied, where $\lambda_2$ is the radius difference between that portion and the diameter-increased hole 18. Notably, preferably, the clearance between the welding jig 25 and the wall surface of the diameter-increased hole 18; i.e., $\lambda_2-\lambda_1$, is set to 0.1 mm or greater.

The following technical idea can be conceived from the above-described first technical means.

"A method of manufacturing an ignition plug, wherein the metal fitting is formed into a cylindrical tubular shape, and the ground electrodes are fixed to a rear end portion of the metal fitting in the above-described first step;

the metallic shell has, at its front end, a diameter-increased hole having a diameter which enables the metal fitting to be fitted therein with a radial clearance formed between the metal fitting and the wall surface of the diameter-increased hole, and the metal fitting is fitted into the diameter-increased hole in the above-described third step; and a convex portion which is provided at an axial end of a welding jig having the form of a stepped round bar is inserted into the front end of the metal fitting, whereby the welding jig is positioned within the diameter-increased hole by the metal fitting such that a clearance is formed between the welding jig and the wall surface of the diameter-increased hole, and electricity is supplied from the welding jig to the metal fitting, whereby a step portion at the rear end of the diameter-increased hole and the rear end portion of the metal fitting are joined together through resistance welding in the above-described fourth step."

Second Technical Means

Figure 36:
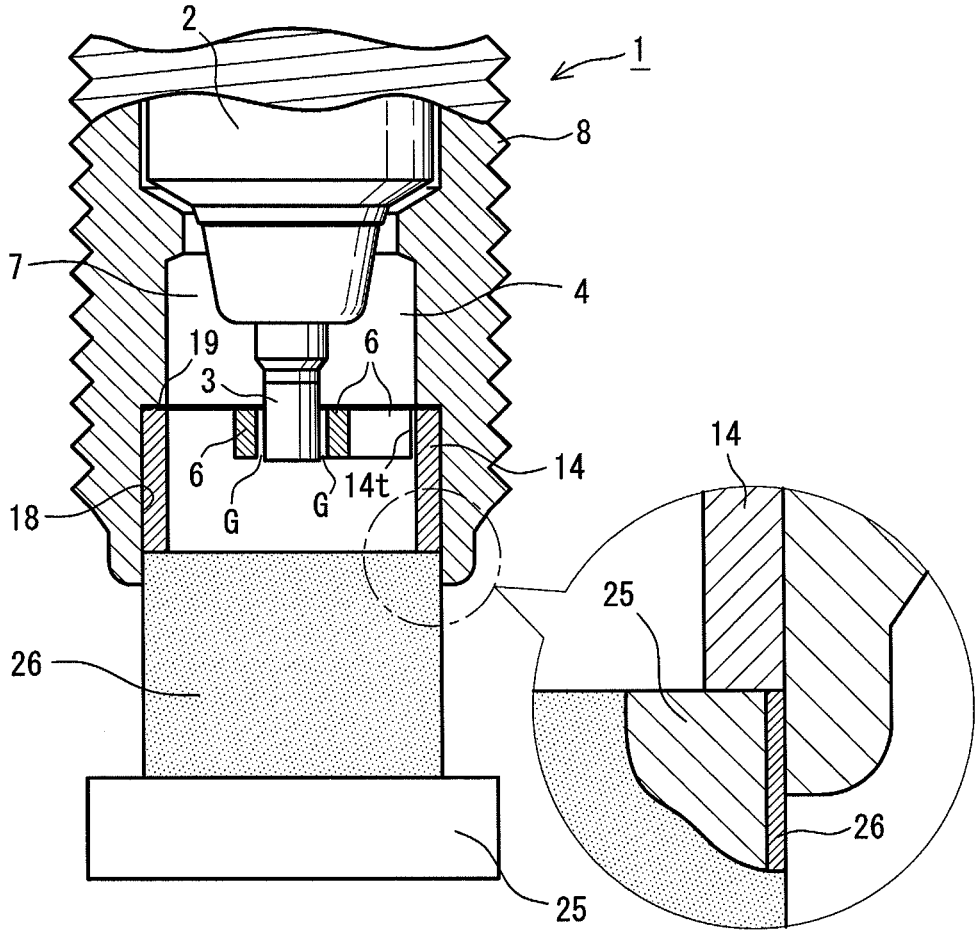
FIG. 36 is a vertical sectional view of a main portion of a prechamber plug showing a state at the time of resistance welding.

In order to prevent the welding current from flowing to the metallic shell 1 through the contract area between the outer circumferential surface of the welding jig 25 and the wall surface of the diameter-increased hole 18, an insulating material 26, such as fluororesin or silicon grease, is applied to the outer circumferential surface of the welding jig 25 to form a film thereon, as shown in FIG. 36 (in particular, an enlarged view of this drawing). Since the insulating material 26 insulates the metallic shell 1 and the welding jig 25 from each other, the flow of the welding current from the welding jig 25 to the metallic shell 1 is broken. Also, through setting the outer diameter of the welding jig 25, including the insulating material 26, such that the welding jig 25, including the insulating material 26, closely fits the diameter-increased hole 18, the contact area between the welding jig 25 and the metal fitting 14 increases, whereby electrical resistance decreases. Therefore, consumption of the welding jig 25 is suppressed.

A plurality of trial products having a structure as shown in FIG. 28 were manufactured through employment of the second technical means (the insulating material=fluororesin), and the above-described joint strength test were carried out for the trial products. The result of the joint strength test was shown in the graph of FIG. 44 as "Second Technical Means." The result demonstrates that a higher joint strength can be consistently attained as compared with Comparative Example.

The following technical idea can be conceived from the above-described second technical means.

"A method of manufacturing an ignition plug, wherein the metal fitting is formed into a cylindrical tubular shape, and the ground electrodes are fixed to a rear end portion of the metal fitting in the above-described first step;

the metallic shell has, at its front end, a diameter-increased hole having a diameter which enables the metal fitting to be fitted therein, and the metal fitting is fitted into the diameter-increased hole in the above-described third step; and a welding jig which has the form of a round bar and whose outer circumferential surface is covered with an insulating member is butted against the front end of the metal fitting, and electricity is supplied from the welding jig to the metal fitting, whereby a step portion at the rear end of the diameter-increased hole and the rear end portion of the metal fitting are joined together through resistance welding in the above-described fourth step."

Third Technical Means

Figure 37:
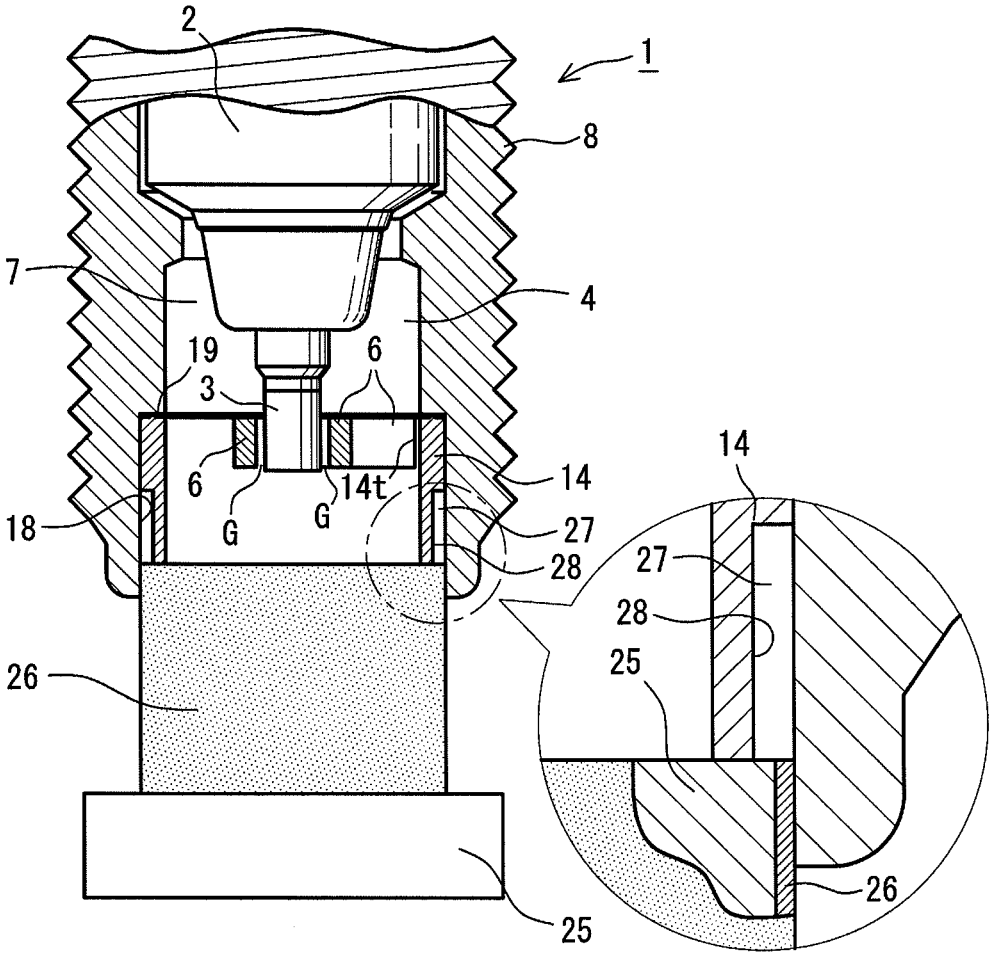
FIG. 37 is a vertical sectional view of a main portion of a prechamber plug showing a state at the time of resistance welding.
Figure 38:
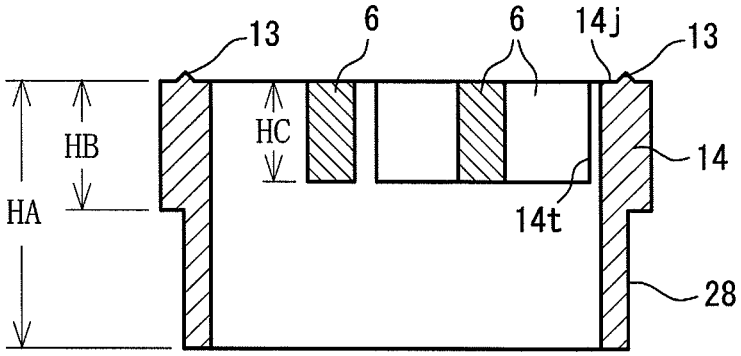
FIG. 38 is a vertical sectional view of a metal fitting.
Figure 39:
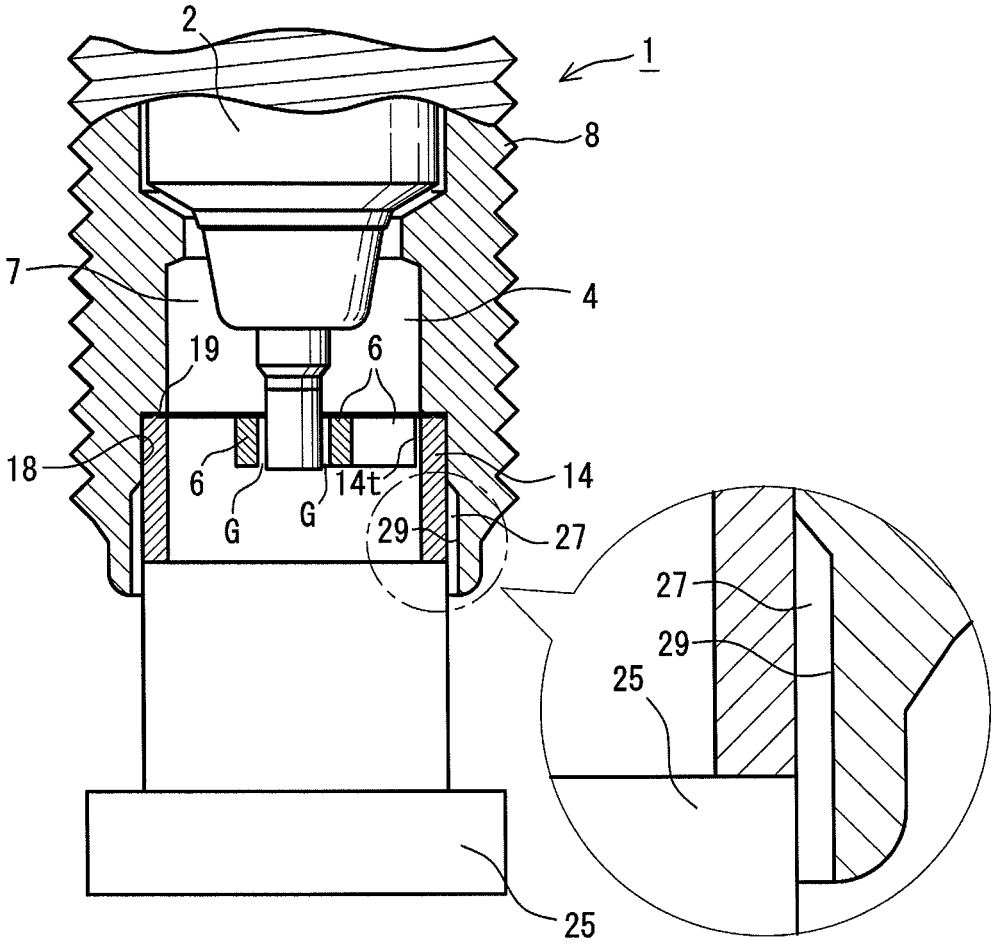
FIG. 39 is a vertical sectional view of a main portion of a prechamber plug showing a state at the time of resistance welding.

The above-mentioned welding current disperses through the entire contact surface between the outer circumferential surface of the metal fitting 14 and the wall surface of the diameter-increased hole 18 of the metallic shell 1. In order to restrain the dispersion of the welding current, as shown in FIGS. 37 and 39, a clearance 27 is formed between the outer circumferential surface of the metal fitting 14 and the wall surface of the diameter-increased hole 18, whereby the contact area is reduced. Thus, the dispersion of the welding current through the contact surface between the metal fitting 14 and the wall surface of the diameter-increased hole 18 is restrained. The clearance 27 is formed by providing a recess 28 on the outer circumferential surface of the metal fitting 14 as shown in FIGS. 37 and 38, or by providing a recess 29 on the wall surface of the diameter-increased hole 18 of the metallic shell 1 as shown in FIG. 39. Alternatively, although not illustrated, the clearance 27 is formed by providing the recesses 28 and 29 on the metal fitting 14 and the metallic shell 1, respectively.

In the case where the contact area is reduced by forming the clearance 27 between the outer circumferential surface of the metal fitting 14 and the wall surface of the diameter-increased hole 18, the welding current concentrates at a limited contract region between the metal fitting 14 and the wall surface of the diameter-increased hole 18. Therefore, the welding strength of the metal fitting 14 increases, and thus, the welding strength of the ground electrodes 6 increases.

In order to prove this, the following test was carried out. There were manufactured a plurality of types of trial products in which, as shown in FIGS. 37 and 38, the clearance 27 was formed between the outer circumferential surface of the metal fitting 14 and the wall surface of the diameter-increased hole 18 by providing the recess 28 on the outer circumferential surface of the metal fitting 14. The plurality of types of trial products were manufactured through use of the welding jig 25 of the second technical means such that they differed from each other in the distance HB (shown in FIG. 38) between the rear end of the metal fitting 14 and the recess 28. The above-described joint strength test was carried out for the trial products. The results of the joint strength test were shown in the graph of FIG. 45. Notably, in the graph of FIG. 45, the horizontal axis represents a dimensional ratio (HB/HA)×100 (%), where HA is the overall height of the metal fitting 14. Accordingly, the trial product whose dimensional ratio is 100% has the structure of FIG. 28, in which the recess 28 is not provided on the metal fitting 14. Therefore, the data of that trial product are identical with the data of "Second technical means" in the graph of FIG. 44. Moreover, the data of the trial product whose dimensional ratio is 40% are identical with the data of "Third technical means" in the graph of FIG. 44.

Figure 45:
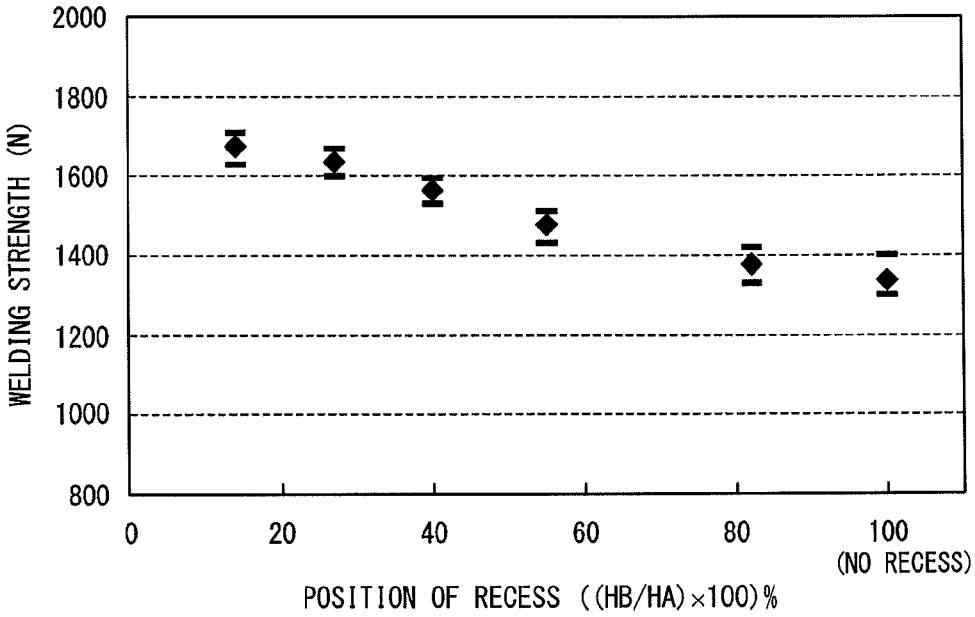
FIG. 45 is a graph showing the relation between recess position and welding strength.

The graph of FIG. 45 demonstrates that the greater the reduction of the contact area attained through formation of the clearance 27 between the outer circumferential surface of the metal fitting 14 and the wall surface of the diameter-increased hole 18, the higher the joint strength of the ground electrodes 6 attained.

Also, the results of the test demonstrate that the welding between the rear end of the metal fitting 14 and the step portion 19 of the diameter-increased hole 18 mainly determines the welding strength of the metal fitting 14 in the axial direction. Therefore, preferably, molten regions which are formed along the end surface and circumferential surface of the metal fitting 14 at the time of welding between the metal fitting 14 and the metallic shell 1 satisfy a relation (the area of the molten region along the end surface) (the area of the molten region along the circumferential surface).

Figure 40:
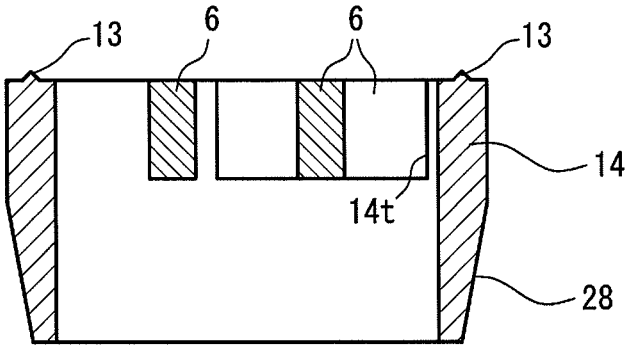
FIG. 40 is a vertical sectional view of a metal fitting.
Figure 41:
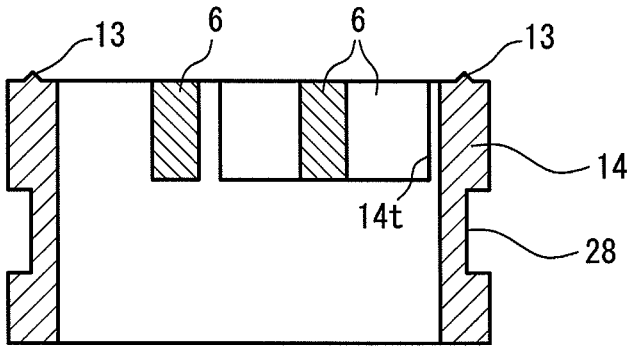
FIG. 41 is a vertical sectional view of a metal fitting.

The means for providing the recess 28 on the metal fitting 14 in the third technical means is not limited to that shown in FIG. 38. For example, as shown in FIG. 40, the recess 28 may be formed by reducing the diameter of a front end portion of the metal fitting 14 such that the font end portion has a taper shape. Alternatively, as shown in FIG. 41, the recess 28 may be formed by forming a concave groove on a trunk portion of the metal fitting 14. Also, although not illustrated, the recess 28 may be formed on the rear end side of the metal fitting 14, unlike the cases of FIGS. 38 and 40 where the recess 28 is formed on the opposite side (front end side). However, in the cases of FIGS. 38 and 40 where the recess 28 is formed on the front end side of the metal fitting 14, heat transferred to the ground electrodes 6 during operation of the internal combustion engine can more easily escape to the outside via a weld region between the metal fitting 14 and the metallic shell 1. Therefore, the heat load acting on the ground electrodes 6 can be reduced.

Also, preferably, the recess 28 of the metal fitting 14 is provided at a position shifted toward the front end of the metal fitting 14 from the position where the ground electrodes 6 are joined thereto. That is, as shown in FIG. 38, the distance HC between the rear end of the metal fitting 14 and the position where the ground electrodes 6 are joined thereto is rendered smaller than the distance HB between the rear end of the metal fitting 14 and the recess 28. In this case, since the volumes of the joint portions between the proximal end portions 6*a* of the ground electrodes 6 and the metal fitting 14 do not decrease, whereby the ground electrodes 6 can have a sufficiently high joint strength.

Fourth Technical Means

Figure 42:
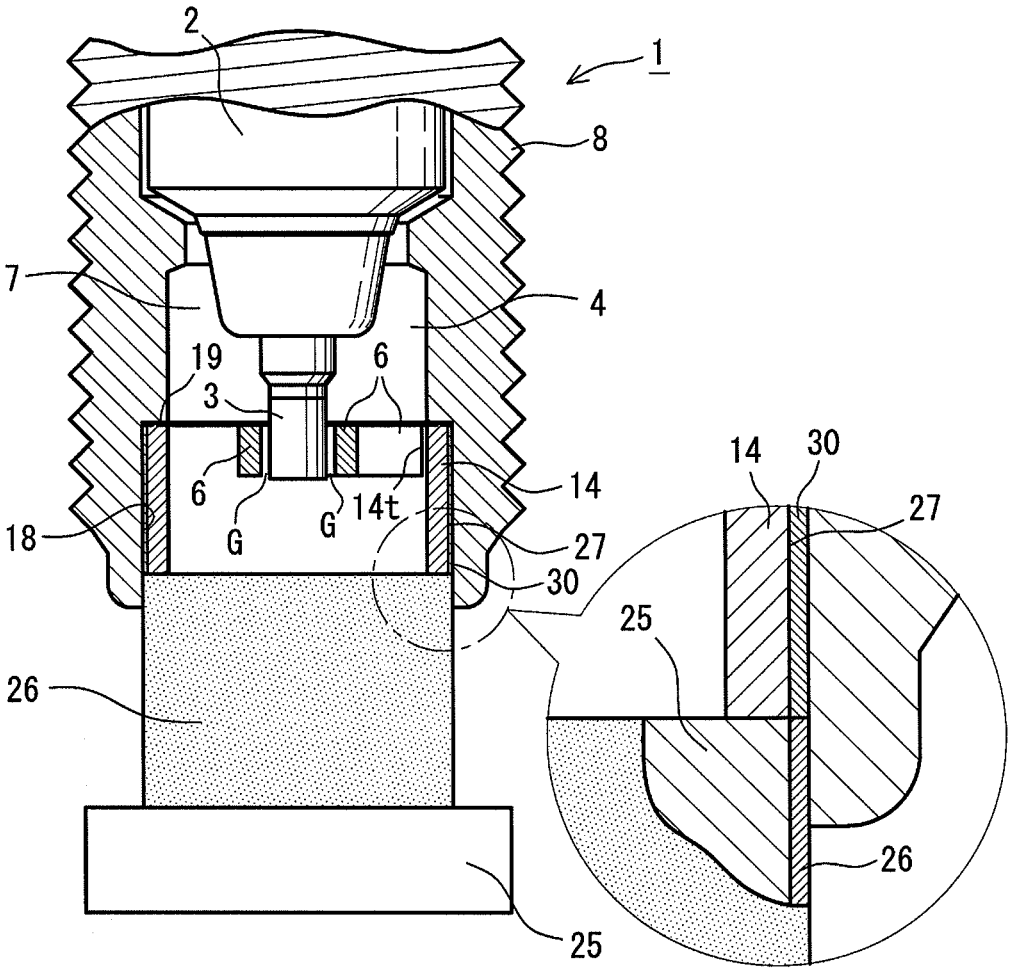
FIG. 42 is a vertical sectional view of a main portion of a prechamber plug showing a state at the time of resistance welding.
Figure 43:
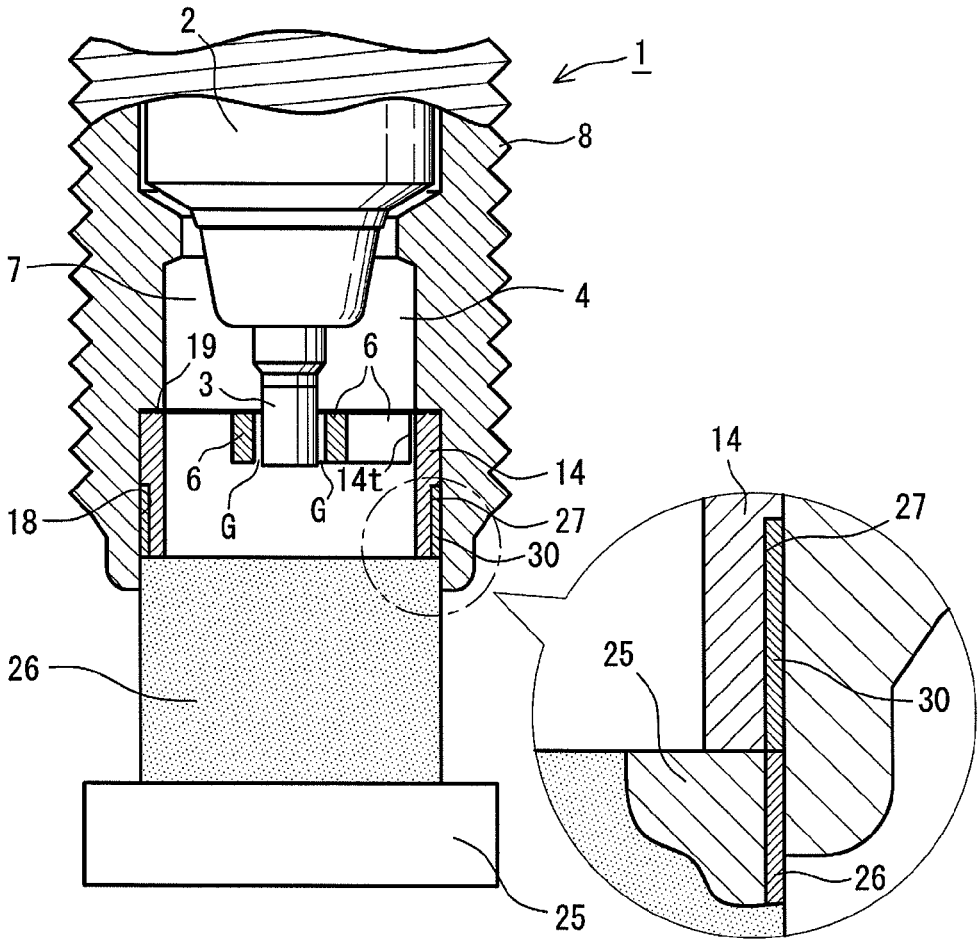
FIG. 43 is a vertical sectional view of a main portion of a prechamber plug showing a state at the time of resistance welding.

In order to prevent the above-described dispersion of the welding current through the contact surface between the outer circumferential surface of the metal fitting 14 and the wall surface of the diameter-increased hole 18 of the metallic shell 1, as shown in FIG. 42, the outer diameter of the metal fitting 14 is made smaller than the diameter of the diameter-increased hole 18 of the metallic shell 1 so as to from the clearance 27 between the outer circumferential surface of the metal fitting 14 and the wall surface of the diameter-increased hole 18 of the metallic shell 1; and an insulating material 30, such as fluororesin or silicon grease, is charged into the entire clearance 27. Specifically, the insulating material 30 is applied to the outer circumference of the metal fitting 14 to thereby form a film thereon, and the metal fitting 14 is then fitted into the diameter-increased hole 18. Then, the welding jig 25 of the first or second technical means is butted against the front end of the metal fitting 14, and a welding current is supplied to the metal fitting 14. Since the insulating material 30 prevents formation of an electrical path which would otherwise pass through the contact surface between the metal fitting 14 and the wall surface of the diameter-increased hole 18, the welding current can be effectively concentrated at a welding point where the metal fitting 14 is welded to the wall surface of the diameter-increased hole 18. Moreover, since the metal fitting 14 is closely fitted into the diameter-increased hole 18 via the insulating material 30, positioning of the metal fitting 14 within the diameter-increased hole 18 becomes easy.

Figure 44:
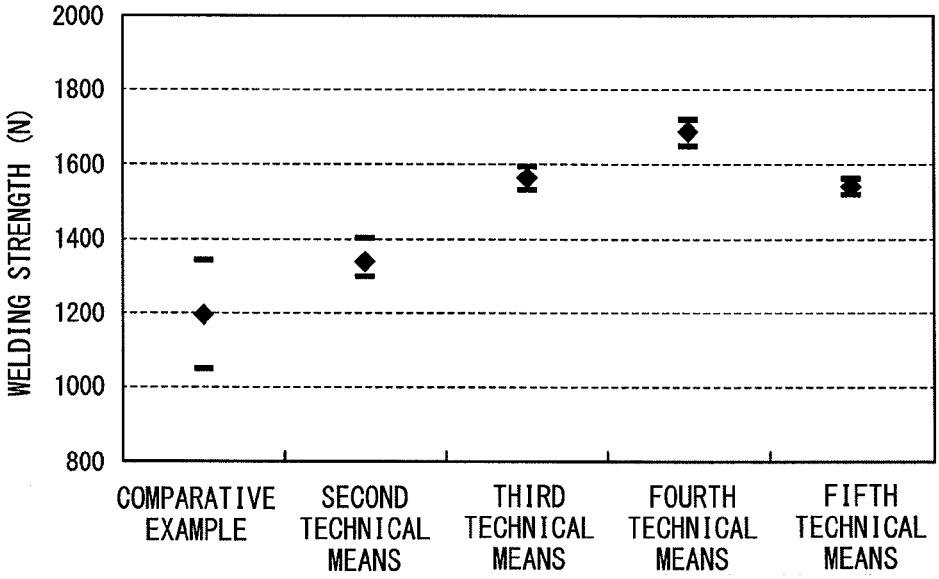
FIG. 44 is a graph showing the results of joint strength tests performed for different technical means.

A plurality of trial products having a structure according to the fourth technical means were manufactured through use of the welding jig 25 of the second technical means, and the above-mentioned joint strength test was performed for the trial products. The result of this test is shown in the graph of FIG. 44 as "Fourth Technical Means." The insulating material 30 used for the trial products was silicon grease.

Notably, in the case where a material whose thermal conductivity is equal to or higher than that of air is used as the insulating material 30, heat radiation performance is enhanced, as compared with the case where the insulation is provided by the clearance 27 only, whereby the influence of heat load can be mitigated. Fluororesin and silicon grease, which have been described as examples of the insulating material 30, satisfy that condition.

Preferably, the insulating material 30 has a dielectric strength of 0.1 kV/mm or greater and a thickness of 0.1 mm or greater.

Fifth Technical Means

In contrast to the above-described fourth technical means, in which the insulating material 30 is provided over the entire space between the outer circumferential surface of the metal fitting 14 and the wall surface of the diameter-increased hole 18 of the metallic shell 1, in the fifth technical means, the insulating material 30 is provided only in the clearance 27 formed by the recess 28 of the metal fitting 14 of the third technical means. Since the insulating material 30 is the same as that employed in the fourth technical means, its description will not be repeated.

A plurality of trial products having a structure according to the fifth technical means were manufactured through use of the welding jig 25 of the second technical means, and the above-mentioned joint strength test was performed for the trial products. The result of this test is shown in the graph of FIG. 44 as "Fifth Technical Means." The insulating material 30 used for the trial products was silicon grease.

The manufacturing method of the second embodiment has been described in the above. However, the directions of the metallic shell 1, the metal fitting 14, and the welding jig 25 in each step shown in the drawings are example directions merely for facilitating their descriptions, and the directions are not limited to the vertical direction.

Figure 27:
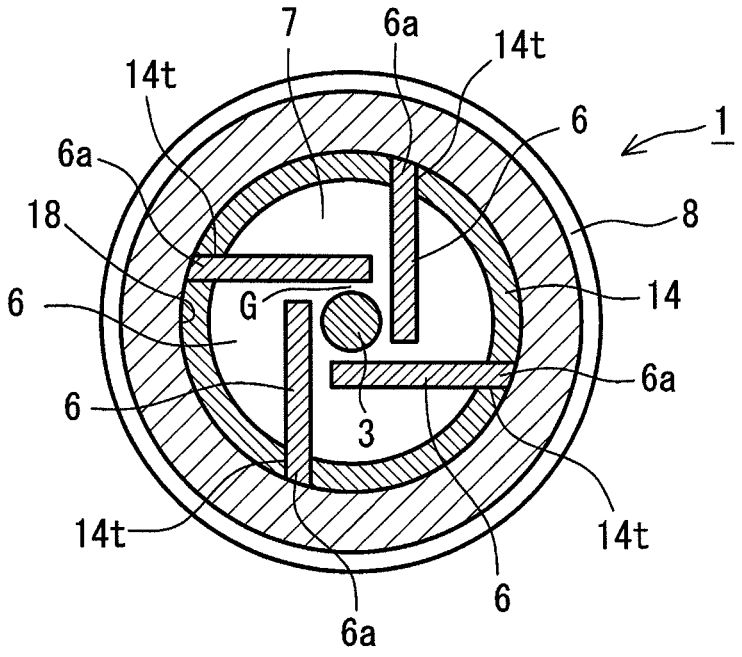
FIG. 27 is a sectional view taken along line III-III of FIG. 26.

Incidentally, in the present invention, in the case where three or more ground electrodes 6 are disposed at equal intervals such that they are cantilevered and extend in corresponding cord directions, as shown in FIGS. 17 and 27, a clearance is provided between the distal end of each ground electrode 6 and a side surface of another ground electrode 6 so as to prevent contact therebetween. The size of the clearance is smaller than the length of a joint portion of the ground electrode 6 held between the metallic shell 1 and the metal fitting 14. By virtue of this configuration, even in the case where the joint of the proximal end portion 6*a* breaks and the ground electrode 6 moves between the metallic shell 1 and the metal fitting 14, the distal end of the ground electrode 6 butts against the side surface of another ground electrode 6 and stops. Therefore, the ground electrode 6 does not fall into the combustion chamber of the internal combustion engine or into the ignition chamber 4.

Although the second embodiment of the present invention has been described, needless to say, the present invention is not limited to the second embodiment. For example, in the second embodiment, the protrusion 13 for resistance welding is provided at the end of the metal fitting 14. However, the protrusion 13 may be provided on the joint surface 1*j* of the metallic shell 1.

Also, the first technical means and the second technical means may be combined. Moreover, the combination or either of the first and second technical means may be combined with the third to fifth technical means in any manner, or each of the first through fifth technical means may be used solely.

The following first through fifth technical ideas can be conceived from the description of the above-described embodiments (including the basic structure of the second embodiment).

First Technical Idea

An ignition plug comprising:

a metallic shell having a through hole extending therethrough in an axial direction;

an insulator fitted into the through hole of the metallic shell and having an axial hole extending in the axial direction;

a center electrode fitted into a front end portion of the axial hole of the insulator; and a ground electrode having a proximal end portion fixed to the metallic shell and a distal end portion which faces the center electrode via a gap, wherein the ignition plug further comprises a metal fitting disposed adjacent to the proximal end portion, and the proximal end portion is fixedly held between the metal fitting and the metallic shell.

In this ignition plug, since the ground electrode is fixed to the metallic shell via the metal fitting, the joint strength and durability of the ground electrode improve, and the joint strength of the ground electrode is unlikely to decrease even when a heat load acts on the ground electrode for a long time.

Second Technical Idea

The ignition plug described in the first technical idea, wherein the ground electrode is joined to at least one of the metal fitting and the metallic shell.

This ignition plug has a further enhanced durability against heat load. Notably, herein, the term "joint" encompasses not only means for fitting the proximal end portion of the ground electrode into a clearance (e.g., a groove) but also all means for unifying the two members so as to enable the members to be handled as a single member, such as welding and brazing.

Third Technical Idea

The ignition plug described in the first or second technical idea, wherein the metallic shell and the metal fitting have respective joint surfaces which are joined together in the axial direction.

In this ignition plug, since the metallic shell and the metal fitting have respective joint surfaces which are joined together in the axial direction, the strength of joint therebetween can be increased, whereby the joint strength of the ground electrode can be increased.

Fourth Technical Idea

The ignition plug described in the third technical idea, wherein the contact area between the joint surfaces of the metal fitting and the metallic shell is equal to or greater than the contact area between the joint surfaces of the ground electrode and the metallic shell.

In this ignition plug, the joint strength can be increased without fail.

Fifth Technical Idea

The ignition plug described in any one of the first through fourth technical ideas, further comprising a cap member which covers a front end opening of the metal fitting or the metallic shell to thereby form an ignition chamber.

In this ignition plug, since the metal fitting is fixed by the cap member as well, the joint strength of the metal fitting can be increased, whereby the joint strength of the ground electrode can be increased.

Third Embodiment

In the gap adjustment steps of the above-described first and second embodiments, when a rod-shaped tool 50 is inserted into the front end opening 10 of the metallic shell 1 so as to apply a load on one ground electrode 6 as shown in FIG. 55, the rod-shaped tool 50 is obliquely inserted to press the ground electrode 6 in a lever fashion. Therefore, so as to follow the inclination of the tool 50, the ground electrode 6 may tilt at an angle θ in relation to the circumferential surface of the center electrode 3. As a result, a gap difference may arise between the front end side (the upper corner portion in FIG. 55) and the rear end side (the lower corner portion in FIG. 55) of the single ground electrode 6. In view of such a drawback, a gap adjustment step which enables the gap adjustment to be performed more accurately will now be described as a third embodiment.

Gap Adjustment Step

Figure 46:
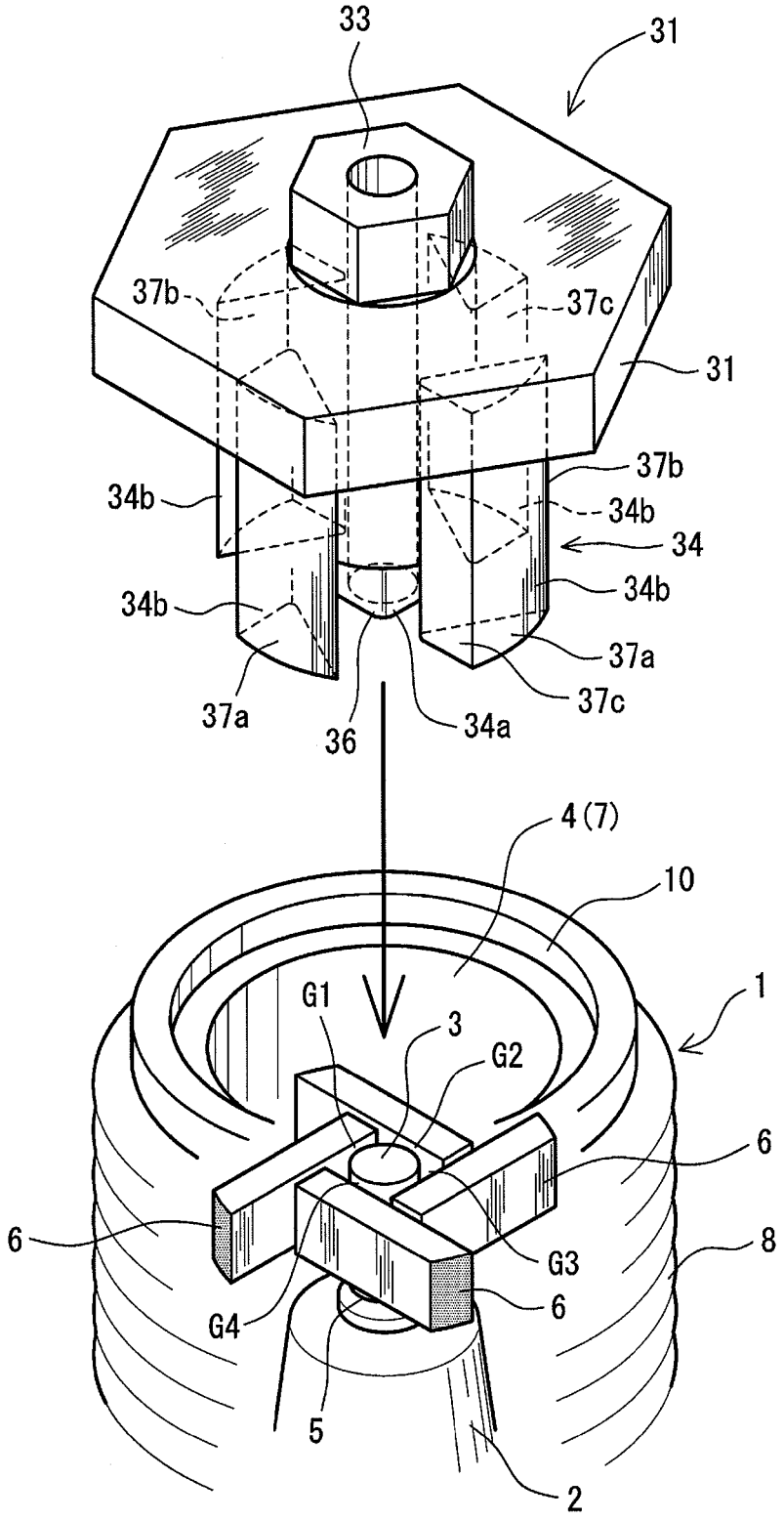
FIG. 46 is a partially transparent perspective view showing a state immediately before an adjustment jig is inserted into the through hole of a metallic shell.
Figure 47:
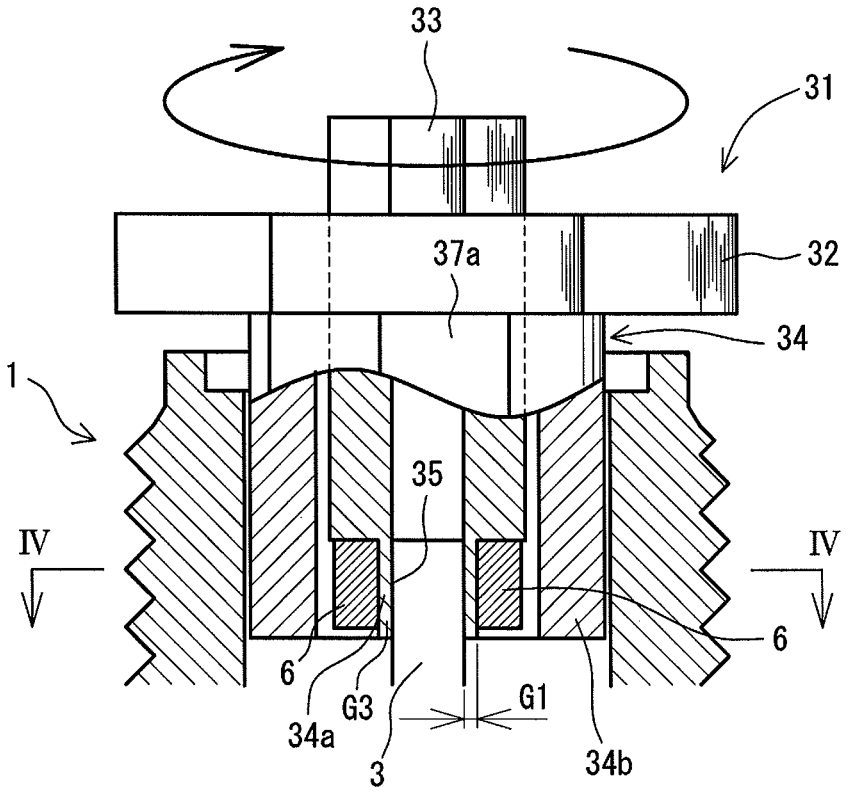
FIG. 47 is a vertical sectional view showing a state at the time of gap adjustment.
Figure 48A:
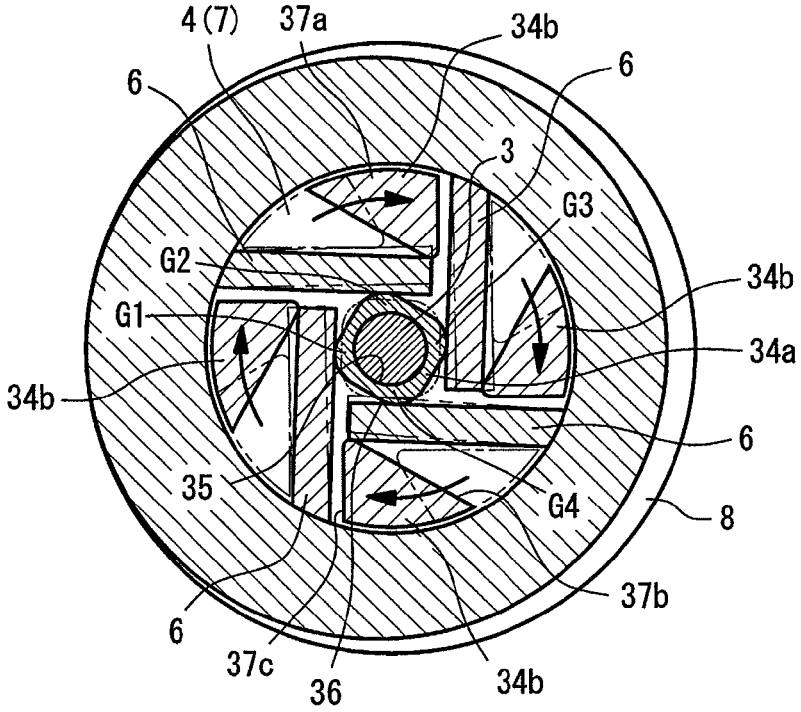
FIG. 48*a* is a sectional view taken along line IV-IV of FIG. 47.
Figure 48B:
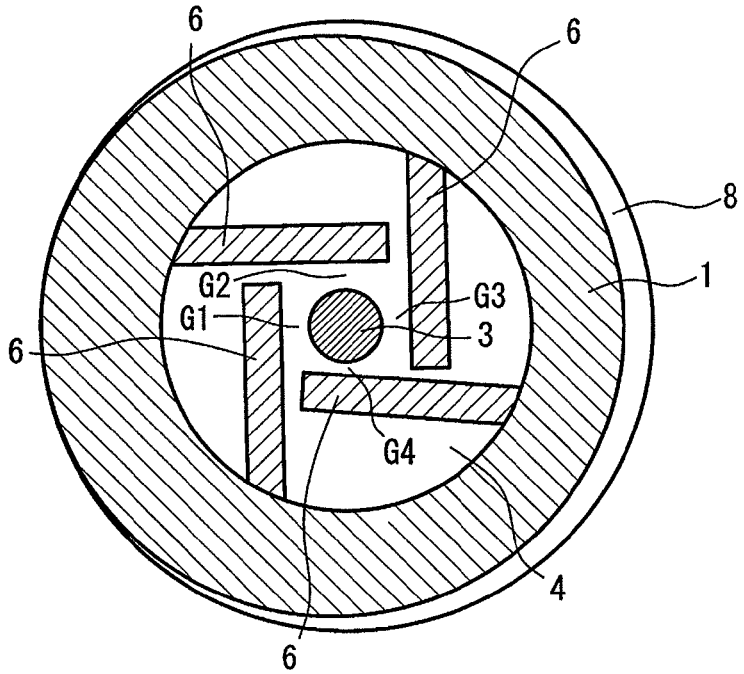
FIG. 48*b* is a sectional view taken along line IV-IV of FIG. 47 and showing a state before gap adjustment.

In the gap adjustment step of the third embodiment, the gaps (clearances) G1 to G4 between the circumferential surface of the center electrode 3 and the distal end portions of the ground electrodes 6 are adjusted to a prescribed range through use of an adjustment jig 31 shown in FIGS. 46 to 48(*a*).

Adjustment Jig

As shown in FIG. 46, the adjustment jig 31 is composed of a base plate 32 which has a polygonal shape, for example, and which can be engaged with a tool such as a torque wrench; a polygonal-columnar tool engagement portion 33 which is rotatably passed through the center of the base plate 32; and a press member 34 formed on the base plate 32 and the tool engagement portions 33.

The press member 34 of the adjustment jig 31 is composed of an expansion press member 34*a* connected to the tool engagement portion 33; and reduction press members 34*b* projecting from the base plate 32 such that they surround the circumference of the expansion press member 34*a*.

Expansion Press Member of the Press Member

For example, when the size of the gap G4 between the center electrode 3 and the corresponding ground electrode 6 is smaller than the prescribed range as shown in FIG. 48(*b*), the expansion press member 34*a* deforms the ground electrode 6 in a direction away from the center electrode 3.

The expansion press member 34*a* is formed of, for example, fluororesin, and has at its center an insertion hole 35, through which the center electrode 3 is passed. The circumferential surface of the expansion press member 34*a* has press cam portions 36 which face the side surfaces of the ground electrode 6 on the side toward the center electrode 3. In the third embodiment, the number of the press cam portions 36 is four equal to the number of the ground electrodes 6 such that one press cam portions 36 is provided for one ground electrode 6. Each press cam portion 36 has a rounded convex shape. When the expansion press member 34*a* is rotated about the center electrode 3, the free end of the ground electrode 6 whose gap G4 is smaller than the prescribed range deflects toward the side opposite the center electrode 3 along the curved cum surface of the press cam portion 36 (from the position indicated by a two-dot chain line in FIG. 48(*a*) to the position indicated by a solid line in FIG. 48(*a*), whereby the ground electrode 6 deforms plastically. As a result, the gap G4 between the center electrode 3 and the ground electrode 6 is expanded to the prescribed range.

Reduction Press Member of the Press Member

For example, when the sizes of the gaps G1 to G3 between the center electrode 3 and the corresponding ground electrodes 6 are greater than the prescribed range as shown in FIG. 48(*b*), the corresponding reduction press members 34*b* press the ground electrodes 6 toward the center electrode 3.

The reduction press members 34*b* are formed of, for example, a copper alloy, and one reduction press member 34*b* is provided for one ground electrode 6. Therefore, in the third embodiment, the four reduction press members 34*b* are formed at intervals of 90 degrees about the expansion press member 34*a*. Each expansion press member 34*b* generally assumes the form of a triangular column having an arcuate first surface 37*a* extending along the wall surface of the through hole 7 of the metallic shell 1, a second surface 37*b* which generally extends along the side surface of the corresponding ground electrode 6 opposite the center electrode 3 when the expansion press member 34*b* is located at a start position before start of the adjustment (see a two-dot chain line in FIG. 48(*a*)), and a third surface 37*c* which generally extends along the side surface of an adjacent ground electrode 6 on the side toward the center electrode 3 when the expansion press member 34*b* is located at an end position after completion of the adjustment (see a solid line in FIG. 48(*a*)). A rounded contact portion 38 is formed at the corner between the second surface 37*b* and the third surface 37*c*. Therefore, when the reduction press members 34*b* are rotated about the center electrode 3, the contact portions 38 press the free ends of the ground electrodes 6 toward the center electrode 3, whereby the sizes of the gaps G1 to G3 are reduced to the prescribed range.

Each of the expansion press member 34*a* and the reduction press members 34*b* assumes the form of a column orthogonally extending from the base plate 32, and has a length determined such that, when the expansion press member 34*a* and the reduction press members 34*b* are inserted into the through hole 7 of the metallic shell 1 in order to perform adjustment (see FIG. 47), their front ends (when the direction of insertion into the through hole 7 of the metallic shell 1 is defined as the front end side) are located at a position equal to the position of the rear end of each ground electrode 6 (the lower side of each ground electrode 6 in FIG. 47) or a position slightly shifted from that position toward the rear end of the through hole 7 (the lower side of the through hole 7 in FIG. 47).

Moreover, each of the expansion press member 34*a* and the reduction press members 34*b* assumes the form of a column which is orthogonal to the surface of the base plate 32, and the contact surface which comes into contact with the corresponding ground electrode 6 extends parallel to the center axis of the metallic shell 1; i.e., parallel to the surface of the ground electrode 6 which faces the contact surface.

Gap Adjustment Work

Gap adjustment work can be performed as follows through use of the above-described adjustment jig 31.

(i) The press member 34 of the adjustment jig 31 is inserted into the through hole 7 of the metallic shell 1 from the front end side thereof as indicated by an arrow in FIG. 46. At that time, as shown in FIG. 47, the center electrode 3 is passed through the insertion hole 35 of the expansion press member 34*a*, and the reduction press members 34*b* are located at the start position indicated by the two-dot chain line in FIG. 48(*a*); that is, at a position in which the second surfaces 37*b* of the reduction press members 34*b* extend along the surfaces of the ground electrodes 6 opposite the center electrode 3.

(ii) Next, as indicated by arrows in FIGS. 47 and 48(*a*), a rotational torque is applied to the adjustment jig 31 so as to rotate it about the center axis of the metallic shell 1 extending in the axial direction; that is, about the center electrode 3, whereby the adjustment jig 31 is rotated to the end position indicated by the solid line in FIG. 48(*a*). The rotation at that time is provided by a known torque wrench which is connected to the base plate 32 and the tool engagement portion 33 of the adjustment jig 31 and whose rotation torque is set to, for example, 10 Nm. Notably, the base plate 32 and the tool engagement portion 33 may be rotated simultaneously, or may be rotated at different timings.

(iii) As a result, the expansion press member 34*a* acts on the ground electrode 6 whose gap G4 is less in size than the prescribed range, and the reduction press members 34 act on the ground electrodes 6 whose gaps G1 to G3 are greater in size than the prescribed range, whereby all the gaps G1 to G4 are adjusted to the prescribed range through the minimum operation. Notably, when the sizes of the gaps G1 to G4 of the ground electrodes 6 fall within the prescribed range, the expansion press member 34*a* and the reduction press members 34*b* rotate without engaging the ground electrodes 6. Therefore, the gaps G1 to G4 do not change.

(iv) After that, the adjustment jig 31 is removed from the through hole 7 of the metallic shell 1. Thus, the gap adjustment is completed without performing actual measurement through use of a clearance gage or the like.

In order to check actual workability, two groups of ignition plugs (4 poles), each including 30 ignition plugs, were manufactured, and the time actually required for gap adjustment was measured.

The ground electrodes 6 of each ignition plug were formed of Pt-20Ir (hardness: 300 MHV) and had a width of 1 mm in FIG. 48(*a*) and a height of 2 mm as measured in the direction perpendicular to the surface of the sheet on which FIG. 48(*a*) is depicted. In the case of the ignition plugs of the first group, the mounting position of the ground electrodes 6 in relation to the through hole 7 was set to 0 mm from the front end opening 10 (first plug specification). In the case of the ignition plugs of the second group, the mounting position of the ground electrodes 6 was set to 3 mm from the front end opening 1 (second plug specification). The gap adjustment was performed by rotating the adjustment jig 31, while controlling its rotational torque to 10 Nm. The target gap was set to 0.3±0.03 mm.

Notably, for comparison, the time required for performing the gap adjustment through use of the rod-shaped tool 50 shown in FIG. 55 was measured.

The results of the measurement demonstrate that, as compared with the case where the rod-shaped tool 50 was used (10 minutes was required for the ignition plugs of the first plug specification and 30 minutes was required for the ignition plugs of the second plug specification), the required time could be shortened to 5 minutes for both the first and second plug specifications through use of the adjustment jig 31 of the present invention.

Figure 49:
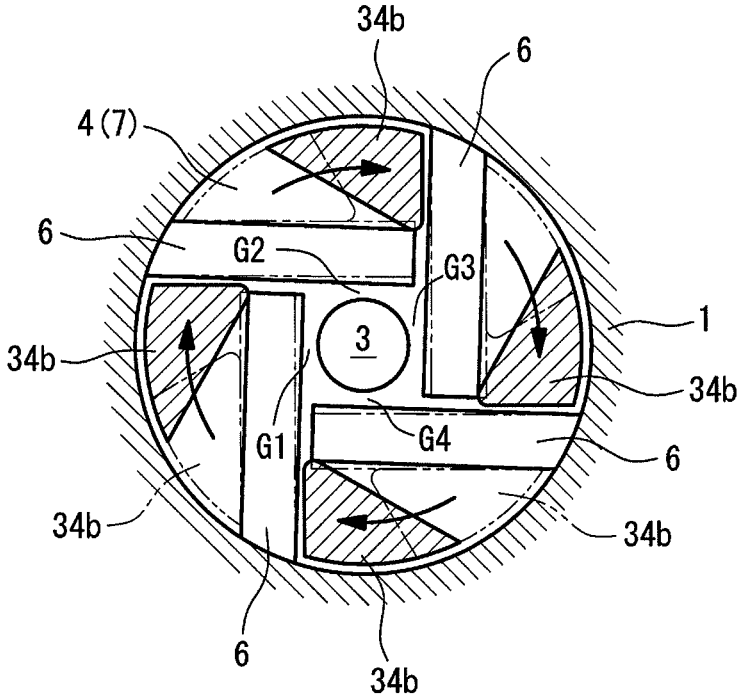
FIG. 49 is a cross-sectional view showing another embodiment at the time of gap adjustment.
Figure 50:
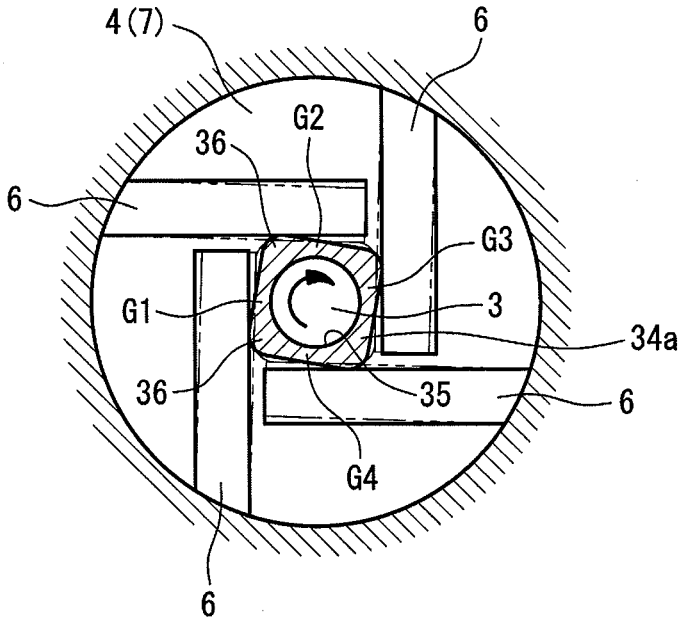
FIG. 50 is a cross-sectional view showing another embodiment at the time of gap adjustment.
Figure 51:
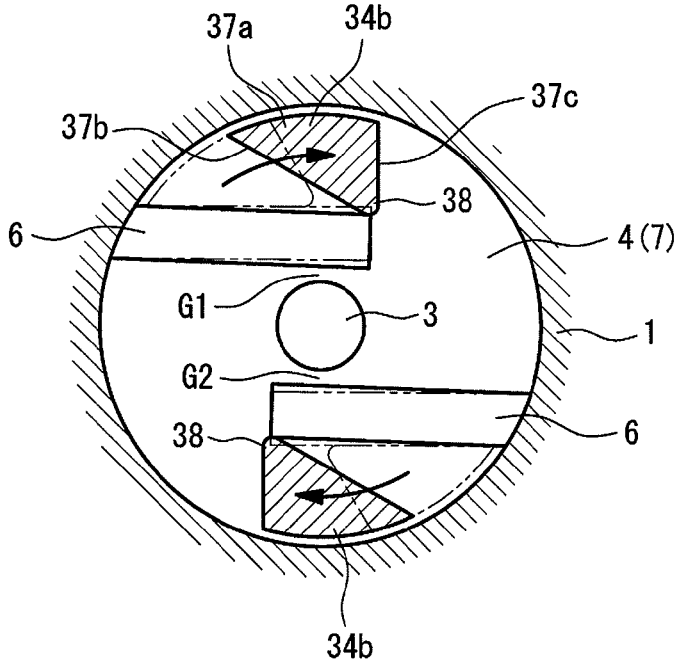
FIG. 51 is a cross-sectional view showing another embodiment at the time of gap adjustment.
Figure 52:
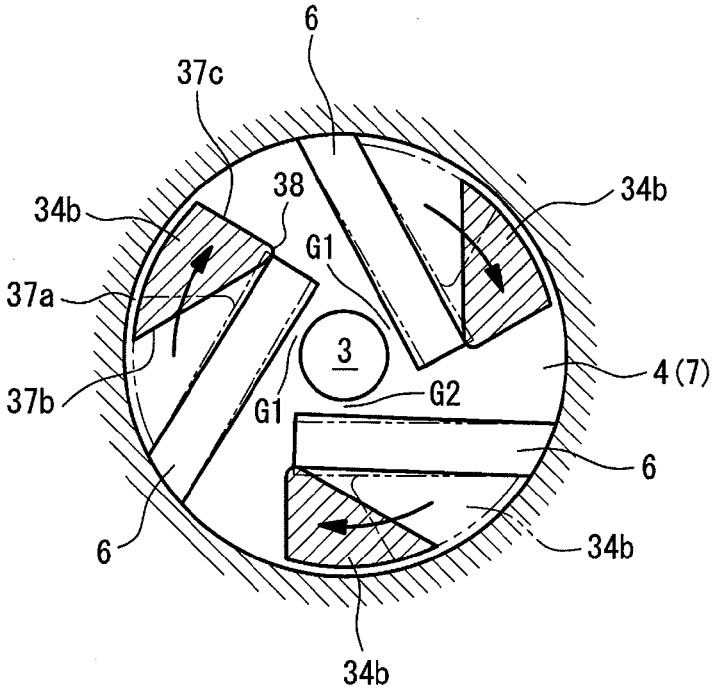
FIG. 52 is a cross-sectional view showing another embodiment at the time of gap adjustment.
Figure 53:
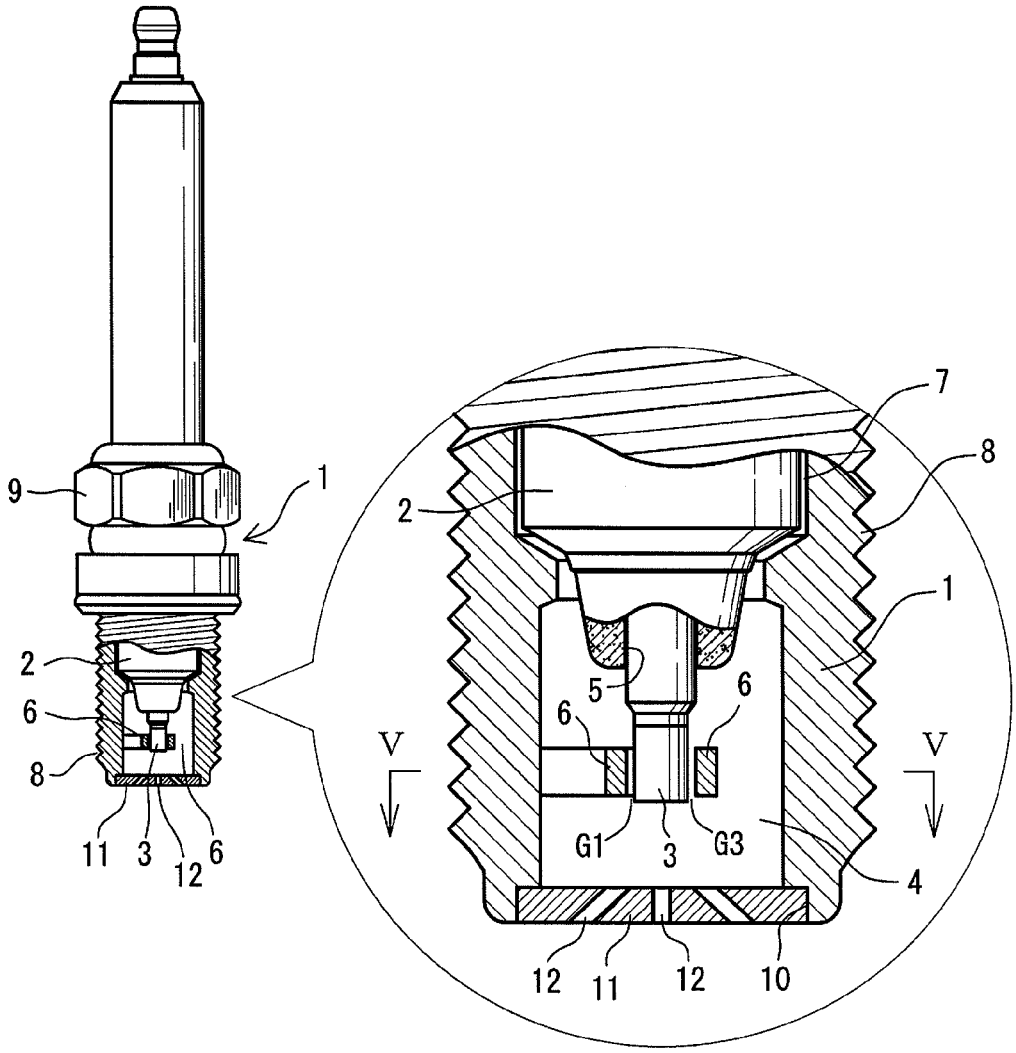
FIG. 53 is a vertical sectional view of an ignition plug including an enlarged view of a main portion thereof.
Figure 54:
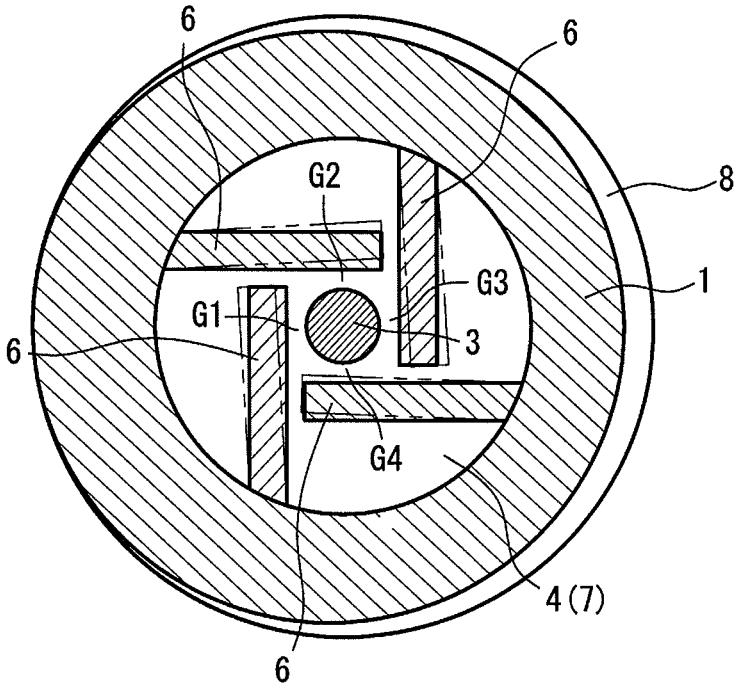
FIG. 54 is a sectional view taken along line V-V of FIG. 53.

Although the gap adjustment step for simultaneously adjusting the gaps G1 to G4 through use of the expansion press member 34*a* and the reduction press members 34*b* has been described, the expansion press member 34*a* and the reduction press members 34*b* may be divided into separate members as shown in, for example, FIGS. 49 and 50 in order to enable the expansion press member 34*a* and the reduction press members 34*b* to be used in separate gap adjustment steps. Also, the number of the ground electrodes 6 may be two as shown in FIG. 51, may be three as shown in FIG. 52, and may be one (not shown).

Ignition Chamber Forming Step

In the ignition chamber forming step, the cap member 11 is fitted into the front end opening 10 of the metallic shell 1, and is welded thereto, whereby the ignition chamber 4 is formed.

The third embodiment of the present invention has been described; however, the present invention is not limited to the third embodiment. For example, in the third embodiment, a prechamber-type ignition plug which has the ignition chamber 4 formed at the front end of the metallic shell 1 is exemplified. However, the present invention can be similarly applied to an ignition plug which does not have the ignition chamber 4. In such a case, the ignition chamber forming step is unnecessary.

In the third embodiment, each of the ground electrodes 6 is a quadrangular bar formed of a noble metal (e.g., Pt-20Ir). However, since such noble metal is expensive, each of the ground electrodes 6 may be a quadrangular bar which is formed of an Ni alloy and which has a noble metal tip at a position facing the circumferential surface of the center electrode 3.

In the third embodiment, gap adjustment is performed after assembly of the insulator 2, the center electrode 3, and the ground electrodes 6 to the metallic shell 1. However, this procedure may be modified such that the ground electrodes 6 are first joined to the metallic shell 1, and then their positions are adjusted through use of the adjustment jig 31, followed by assembly of the insulator 2 and the center electrode 3 to the metallic shell 1. In this case, since the metallic shell 1 is a tubular member, the adjustment jig 31 can be inserted into the metallic shell 1 from either side. Accordingly, the insertion direction of the adjustment jig 31 can be flexibly determined in accordance with the requirement of a manufacturing process.

Having described the invention, the following is claimed:

1. An ignition plug comprising:

a metallic shell having a through hole extending therethrough in an axial direction;

an insulator fitted into the through hole of the metallic shell and having an axial hole extending in the axial direction;

a center electrode fitted into the axial hole of the insulator; and a cap member which covers a front end opening of the metallic shell, provided on a front end side thereof where the center electrode is disposed, to thereby form an ignition chamber in a front end portion of the metallic shell; and a ground electrode disposed within the ignition chamber and facing a circumferential surface of the center electrode directly or indirectly, wherein the ground electrode has a rod-like shape;

a proximal end portion of the ground electrode is fixed to the metallic shell such that the ground electrode is cantilevered and extends in a chord direction of the ignition chamber, and a distal end portion of the ground electrode faces the circumferential surface of the center electrode directly or indirectly via a gap G; and a metal fitting is disposed adjacent to the proximal end portion of the ground electrode, wherein the proximal end portion of the ground electrode is fixedly held between the metal fitting and the metallic shell, wherein the metal fitting has a cylindrical tubular shape; the metallic shell has, at its front end, a diameter-increased hole into which the metal fitting is fitted; and the metal fitting is joined to the metallic shell in a state in which the ground electrode is sandwiched between a step portion at the rear end of the diameter-increased hole and a rear end portion of the metal fitting; and wherein a clearance is formed between an outer circumferential surface of the metal fitting and a wall surface of the diameter-increased hole; and the step portion at the rear end of the diameter-increased hole and the rear end portion of the metal fitting are joined together through resistance welding.

2. An ignition plug according to claim 1, wherein the ground electrode has a second moment of area I of 2 $mm^4$ or less when a load is applied to the distal end in a radial direction of the ignition chamber.

3. An ignition plug according to claim 1, wherein the ground electrode is joined to the metallic shell at a position determined such that a shortest distance between a front end surface of the metallic shell and the ground electrode as measured in the axial direction becomes 3 mm or greater.

4. An ignition plug according to any one of claims 1 to 3, wherein the metallic shell has a screw shaft portion at the front end thereof; and the ground electrode is joined to the metallic shell at a position shifted 3 mm or more from a start point of the screw shaft portion at the front end thereof with respect to the axial direction.

5. An ignition plug according to any one of claims 1 to 3, wherein the ratio of a volume Ve of a portion of the ground electrode, the portion projecting into the ignition chamber, to a volume Vc of the ignition chamber is 10% or less.

6. An ignition plug according to any one of claims 1 to 3, wherein the ratio of a total electrode area Sec, which is the sum of a cross-sectional area Se of the ground electrode as measured on a cross section of the ignition chamber crossing the ground electrode in a radial direction and a cross-sectional area Sc of the center electrode as measured on the cross section, to a cross-sectional area Sp of the cross section of the ignition chamber is 50% or less; and the ratio of a volume Vh of a portion of the ignition chamber extending frontward from a rear end surface of the ground electrode to a volume Vc of the ignition chamber is 50% or greater.

7. An ignition plug according to claim 1, wherein a recess is formed on at least one of the outer circumferential surface of the metal fitting and the wall surface of the diameter-increased hole; and the recess forms the clearance.

8. A method of manufacturing an ignition plug, comprising:

an assembly step of assembling an ignition plug having a metallic shell having a through hole extending therethrough in an axial direction;

an insulator fitted into the through hole of the metallic shell and having an axial hole extending in the axial direction;

a center electrode fitted into the axial hole of the insulator; and a ground electrode disposed within the ignition chamber and facing a circumferential surface of the center electrode directly or indirectly, wherein the ground electrode having a rod-like shape; and a proximal end portion of the ground electrode is fixed to the metallic shell such that the ground electrode is cantilevered and extends in a chord direction of the ignition chamber;

a gap adjustment step of, after the assembly step, adjusting the gap G between the circumferential surface of the center electrode and the ground electrode facing the circumferential surface of the center electrode directly or indirectly; wherein the gap adjustment step uses an adjustment jig which is rotatable about a center axis of the metallic shell extending in the axial direction and is dimensioned such that at least a front end of the adjustment jig can be inserted into the through hole of the metallic shell; and the gap adjustment step includes inserting the adjustment jig into the through hole of the metallic shell along the axial direction of the ignition plug, and rotating the adjustment jig about the center axis so as to press the ground electrode to thereby adjust the gap G; and an ignition chamber forming step of, after the gap adjustment step, attaching a cap member to the front end opening of the metallic shell to thereby form the ignition chamber at the front end portion of the metallic shell.

9. A method of manufacturing an ignition plug, comprising:

an assembly step of assembling an ignition plug having a metallic shell having a through hole extending therethrough in an axial direction;

an insulator fitted into the through hole of the metallic shell and having an axial hole extending in the axial direction;

a center electrode fitted into the axial hole of the insulator; and a ground electrode disposed within the ignition chamber and facing a circumferential surface of the center electrode directly or indirectly, wherein the ground electrode having a rod-like shape; and a proximal end portion of the ground electrode is fixed to the metallic shell such that the ground electrode is cantilevered and extends in a chord direction of the ignition chamber;

a step of fixing ground electrode to a metal fitting; and a step of fixedly attaching the metal fitting, to which the ground electrode has been fixed by the first step, such that the ground electrode is disposed between the metal fitting and the metallic shell, wherein the metal fitting has a cylindrical tubular shape, and the metallic shell has, at its front end, a diameter-increased hole into which the metal fitting is fitted;

the method comprises a step of bringing the welding jig into contact with the front end of the metal fitting and joining the metallic shell and the metal fitting together through resistance welding;

the welding jig used in this step has a convex portion which can be removably inserted into an end portion of the metal fitting and is positioned by the metal fitting; and a radius difference $\lambda_1$ between an inner diameter of the metal fitting and an outer diameter of the convex portion and a radius difference $\lambda_2$ between an inner diameter of the metallic shell and a diameter of a portion of the welding jig facing an inner circumferential surface of the metallic shell satisfy a relation $\lambda_2>\lambda_1$.

10. A method of manufacturing an ignition plug, comprising:

an assembly step of assembling an ignition plug having a metallic shell having a through hole extending therethrough in an axial direction;

an insulator fitted into the through hole of the metallic shell and having an axial hole extending in the axial direction;

a center electrode fitted into the axial hole of the insulator; and a ground electrode disposed within the ignition chamber and facing a circumferential surface of the center electrode directly or indirectly, wherein the ground electrode having a rod-like shape; and a proximal end portion of the ground electrode is fixed to the metallic shell such that the ground electrode is cantilevered and extends in a chord direction of the ignition chamber;

a step of fixedly attaching a metal fitting to the metallic shell, to which the ground electrode has been fixed, such that the metal fitting is located adjacent to the proximal end portion of the ground electrode, wherein the metal fitting has a cylindrical tubular shape, and the metallic shell has, at its front end, a diameter-increased hole into which the metal fitting is fitted;

the method comprises a step of bringing the butting the welding jig into contact with the front end of the metal fitting and joining the metallic shell and the metal fitting together through resistance welding;

the welding jig used in this step has a convex portion which can be removably inserted into an end portion of the metal fitting and is positioned by the metal fitting; and a radius difference $\lambda_1$ between an inner diameter of the metal fitting and an outer diameter of the convex portion and a radius difference $\lambda_2$ between an inner diameter of the metallic shell and a diameter of a portion of the welding jig facing an inner circumferential surface of the metallic shell satisfy a relation $\lambda_2 > \lambda_1$.

* * * * *